US006802782B2

(12) United States Patent
Hall et al.

(10) Patent No.: US 6,802,782 B2
(45) Date of Patent: Oct. 12, 2004

(54) APPARATUS FOR PRODUCING A FIRE SPECIAL EFFECT

(75) Inventors: Rockne Hall, Newhall, CA (US); Joseph W. Starr, Saugus, CA (US)

(73) Assignee: Technifex, Inc., Valencia, CA (US)

( * ) Notice: Subject to any disclaimer, the term of this patent is extended or adjusted under 35 U.S.C. 154(b) by 0 days.

(21) Appl. No.: 10/249,949

(22) Filed: May 21, 2003

(65) Prior Publication Data

US 2004/0077416 A1 Apr. 22, 2004

Related U.S. Application Data

(63) Continuation-in-part of application No. 10/063,264, filed on Apr. 4, 2002, now Pat. No. 6,685,574.

(51) Int. Cl.[7] ..... A63J 5/02
(52) U.S. Cl. ..... 472/65; 40/427
(58) Field of Search ..... 472/65, 66, 61, 472/57, 137; 40/427, 428, 439, 440, 441

(56) References Cited

U.S. PATENT DOCUMENTS 643,493 A * 2/1900 Fuller ..... 472/65
3,334,816 A * 8/1967 Shuzo ..... 239/18
3,432,439 A * 3/1969 Dickman ..... 102/334
4,002,333 A * 1/1977 Gotoh ..... 472/65
4,026,544 A * 5/1977 Plambeck et al. ..... 472/64
4,426,021 A * 1/1984 Rosenthal ..... 222/129.1
4,994,092 A * 2/1991 Eklund et al. ..... 44/629
5,407,392 A * 4/1995 Laijoki-Puska ..... 472/65
5,989,128 A * 11/1999 Baker et al. ..... 472/65

* cited by examiner

*Primary Examiner*—Kien Nguyen
(74) *Attorney, Agent, or Firm*—Holland & Hart LLP; Christopher J. Kulish, Esq.

(57) ABSTRACT

The present invention provides a device for producing a fire special effect using a curtain of theatrical smoke. In one embodiment, the device comprises a theatrical smoke console for producing a curtain of theatrical smoke, an air modulator for providing a varying current of air that modulates the curtain of theatrical smoke produced by the console, and a lighting assembly that produces a flood of colored light that is projected onto the modulated curtain of theatrical smoke produced by the console and air modulator.

45 Claims, 12 Drawing Sheets

APPARATUS FOR PRODUCING A FIRE SPECIAL EFFECT

CROSS REFERENCE TO RELATED APPLICATIONS

This application is a continuation-in-part of U.S. patent application Ser. No. 10/063,264, entitled "APPARATUS FOR PRODUCING A FIRE SPECIAL EFFECT USING STEAM," filed on Apr. 4, 2002, now U.S. Pat. No. 6,685,574, which application is incorporated by reference into this application in its entirety.

FIELD OF THE INVENTION

The present invention is directed to a special effect device and, in particular, to a device for producing a simulated fire or flame special effect.

BACKGROUND OF THE INVENTION

The use of a simulated fire or flame is desirable in many applications. For instance, in many theme park attractions (e.g., volcano, battle scene and disaster scenes), the use of a simulated flame or fire is preferred relative to a real flame or fire for a number of reasons. To elaborate, a real flame or fire must typically be located a substantial distance from the audience to prevent members of the audience from getting burned. Further, with respect to attractions that are located indoors, a real flame or fire produces heat and smoke that typically require additional air conditioning and ventilation. In contrast, several types of simulated flame or fire effects can be located close to an audience and do not typically impose the air conditioning and ventilation requirements of a real flame or fire.

There are many types of devices for producing simulated flames or fire. For example, one type of device blows strips of colored material, such as silk, up into the air and shines an appropriately colored light onto the strips. From a distance, these devices provide a reasonably convincing simulated flame or fire. At the other end of the spectrum are devices that provide a television or video monitor with a signal of a pre-recorded fire or flame. Such devices are impractical in theme park applications that require a flame or fire that extends over a distance that is greater than the typical video monitor or television. Yet a further type of device involves the use of a screen of atomized water and the projection of an image or light on the screen that creates the illusion of a flame or fire.

SUMMARY OF THE INVENTION

The present invention is directed to a special effect device for producing a simulated flame or fire effect. In one embodiment, the special effect device comprises a console for producing a curtain of steam, which is probably more accurately characterized as a fog, adjacent to an outlet slot or port of a housing. The device further comprises an air modulator for producing a stream of air that is used to vary or modulate the curtain of steam produced by the console. The rising steam in the curtain of steam and the modulation of the curtain of steam closely mimics the dynamic action of an actual flame or fire. The special effect device further comprises lighting that directs a flood of appropriately colored light onto the modulated or undulating curtain of steam. The interaction of the flood of light with the moving curtain of steam yields a simulated flame or fire effect.

In one embodiment, the console comprises a steam manifold that contributes to the production of a curtain of steam with a substantially uniform or desired steam density. In one embodiment, the steam manifold has an elongated body with multiple output ports distributed along the length of the elongated body so that a curtain of steam is produced adjacent to the outlet slot for substantially the length of the console. The steam manifold further comprises an inlet port for receiving steam that is located between the ends of the elongated body. Locating the inlet port in this manner permits several such consoles to be placed end-to-end and, because each console is producing a curtain of steam for substantially the length of the console, a curtain of steam is produced over the extent of the consoles that has a uniform or desired steam density. In contrast, if consoles were utilized in which the steam manifold of one console had to be connected to the steam manifold of the next console by a coupler located between the consoles, there would likely be significant gaps between the curtains of steam produced by each console, thereby preventing a uniform or desired steam density from being achieved over the extent of the consoles. Further, even if a string of consoles could be coupled together so as to eliminate or substantially reduce any gaps in the resulting steam curtain, the ability to achieve a uniform or desired steam density over the extent of the string of consoles is facilitated by locating the inlet port for the steam manifold between the ends of the elongated body of the manifold. To elaborate, if the inlet port was not located between the ends of the elongated body of the manifold, a string of consoles would be coupled to one another and steam would be fed into the string of consoles from one or both of the consoles at the end of the string. In such a configuration, the pressure drop along the length of the string would have to be taken into account to achieve a uniform or desired steam density along the length of the string. This significantly complicates the design of a console, i.e., the need to take into account the effect of the other consoles in a string of consoles. In contrast, by placing an inlet port between the ends of the elongated body of the steam manifold, at least for consoles that are not the end consoles of a string, consoles can be independently designed to produce a uniform or desired steam density without having to take into account the effect of other consoles that are to be in a string of consoles.

In another embodiment, a steam manifold is provided that contributes to the production of a steam curtain with a substantially uniform or desired steam density. The manifold comprises an elongated hollow body with an inlet port for receiving steam and an outlet structure that extends over at least a portion of the length of the hollow body and allows steam to exit with a substantially uniform or desired density. In one embodiment, the outlet structure comprises holes in the elongated body of the manifold that are spaced from one another and/or of a size such that a profile of the resistance to steam exiting from the elongated body decreases with increasing distance from the inlet port. For example, if the inlet port is located at the mid-point of the elongated body, one possible outlet structure has two sets of holes extending in opposite directions from the mid-point of the elongated body with each set of holes having holes that are evenly spaced form one another, circular in shape, and increasing in diameter the further a hole is located from the inlet port.

Another embodiment of the special effect device includes a console for producing a relatively tall curtain of steam, which allows a fire of flame illusion to be produced over a broad range of heights. In one embodiment, the console comprises a housing with an outlet slot or port for venting the steam that produces the curtain or screen of steam. A steam manifold located within the housing employs an outlet structure that presents a relatively low resistance to the flow of steam. As a consequence, the outlet structure of the manifold contributes to the height of the curtain of steam produced adjacent to the outlet port of the housing when the special effect device is in operation. In one embodiment, the steam manifold comprises an elongated body and the outlet structure is a series of holes located between the ends of the elongated body. The holes present a relatively low resistance to the flow of steam when compared to fan nozzles. To elaborate, fan nozzles force any steam passing through the nozzle to traverse a 90 degree turn that reduces the velocity of the steam exiting the nozzle. This reduction in velocity means that the fan nozzle exhibits or is characterized by a relatively high resistance to the flow of steam. A hole or other outlet structure does not require the steam to make a 90 degree turn. Consequently, the steam exits the outlet port of the housing at a higher velocity.

In a further embodiment, the console comprises a housing with air entrainment holes that contribute to the density of the curtain of steam produced adjacent to the outlet slot of the housing during operation. By producing a denser curtain of steam, the visibility of the resulting fire effect is improved or enhanced. The air entrainment holes are located below the outlet structure of a steam manifold located within the housing. In one embodiment, the air entrainment holes are located as far below the outlet structure of the steam manifold as possible.

In yet another embodiment, a special effect device is provided for producing a simulated flame or fire effect that utilizes theatrical smoke to produce the effect. Theatrical smoke is atomized glycol or mineral oil that is dispersed into the air and remains suspended in the air for a certain amount of time. Theatrical smoke, unlike steam, does not naturally rise. Consequently, theatrical smoke is commonly used to create "ground fogs" in theatrical productions. In one embodiment, the device comprises a structure for producing a curtain of theatrical smoke. The device is further comprised of an air modulator for producing a stream of air that modulates the curtain of theatrical smoke. Also comprising the device is lighting that operates to direct a flood of light onto the modulated curtain of theatrical smoke.

In a further embodiment, the theatrical smoke-based special effect device comprises a housing with an outlet port that communicates with the ambient atmosphere. The device further comprises a structure for establishing a flow of gas (typically, air) within the housing that is capable of transporting theatrical smoke, which does not naturally rise like steam, to the outlet port and sufficiently above the outlet port to create a curtain of theatrical smoke on which the illusion of a flame or fire can be created. Also comprising the device is a theatrical smoke emission manifold that is substantially located within the housing and further located so as to be disposed within the flow of gas, when the device is in operation. The device further comprises an air modulator and lighting that respectively modulate the curtain of theatrical smoke and light the modulated curtain of theatrical smoke to achieve the simulated flame effect.

Another embodiment of the theatrical smoke-based special effect device comprises a housing with an interior volume. The interior volume is comprised of a chamber and a slot that extends between a slot/chamber junction and an outlet port that communicates with the ambient atmosphere. The device is further comprised of a smoke emission manifold and a gas emission manifold that are both substantially located within the interior volume. The device further comprises an air modulator and lighting that respectively modulate the curtain of theatrical smoke and light the modulated curtain of theatrical smoke to achieve the simulated flame effect. In one embodiment, the smoke emission manifold is located between the outlet port of the slot and the gas emission manifold. In yet a further embodiment, the smoke emission manifold is located between the slot/chamber junction and the gas emission manifold. Yet another embodiment locates the smoke emission manifold so that the manifold cooperates with the housing to define one or more passageways for the flow of gas from the chamber to the outlet port.

A further embodiment of the theatrical smoke-based device comprises a housing, theatrical smoke and gas emission manifolds that are each substantially located within the housing, an air modulator, and a lighting system. Each of the manifolds comprises an inlet port that is located between the ends of the manifold. By locating the inlet ports in this manner, two or more devices can be cascaded together and used to produce a simulated flame or fire effect over substantially the entire length of the devices. In one embodiment, the inlet ports are located at or near the midpoints of the manifolds to facilitate the production of a substantially uniform curtain of theatrical smoke.

Yet another embodiment of the theatrical smoke-based device comprises a housing, theatrical smoke and gas emission manifold that are each substantially located within the housing, an air modulator, and a lighting system. The theatrical smoke manifold comprises a plurality of outlet ports for venting theatrical smoke and that present a desired resistance profile to the flow of theatrical smoke. Similarly, the gas emission manifold comprises a plurality of outlet ports for venting gas and that present a desired resistance profile to the flow of gas. In many cases, the resistance profiles are designed so as to produce a substantially uniform curtain of theatrical smoke.

DETAILED DESCRIPTION

The present invention is directed to a special effect device that utilizes steam to produce a simulated flame or fire effect. Generally, the device includes a steam console for producing a curtain of steam that has a substantially constant or uniform steam density along at least a portion of the length of the console, an air modulator for modulating the curtain of steam produced by the console, and a lighting assembly for illuminating the curtain of steam produced by the console. In operation, illumination of the modulated curtain of steam produced by the console and the air modulator produces a simulated flame effect.

Figure 1:
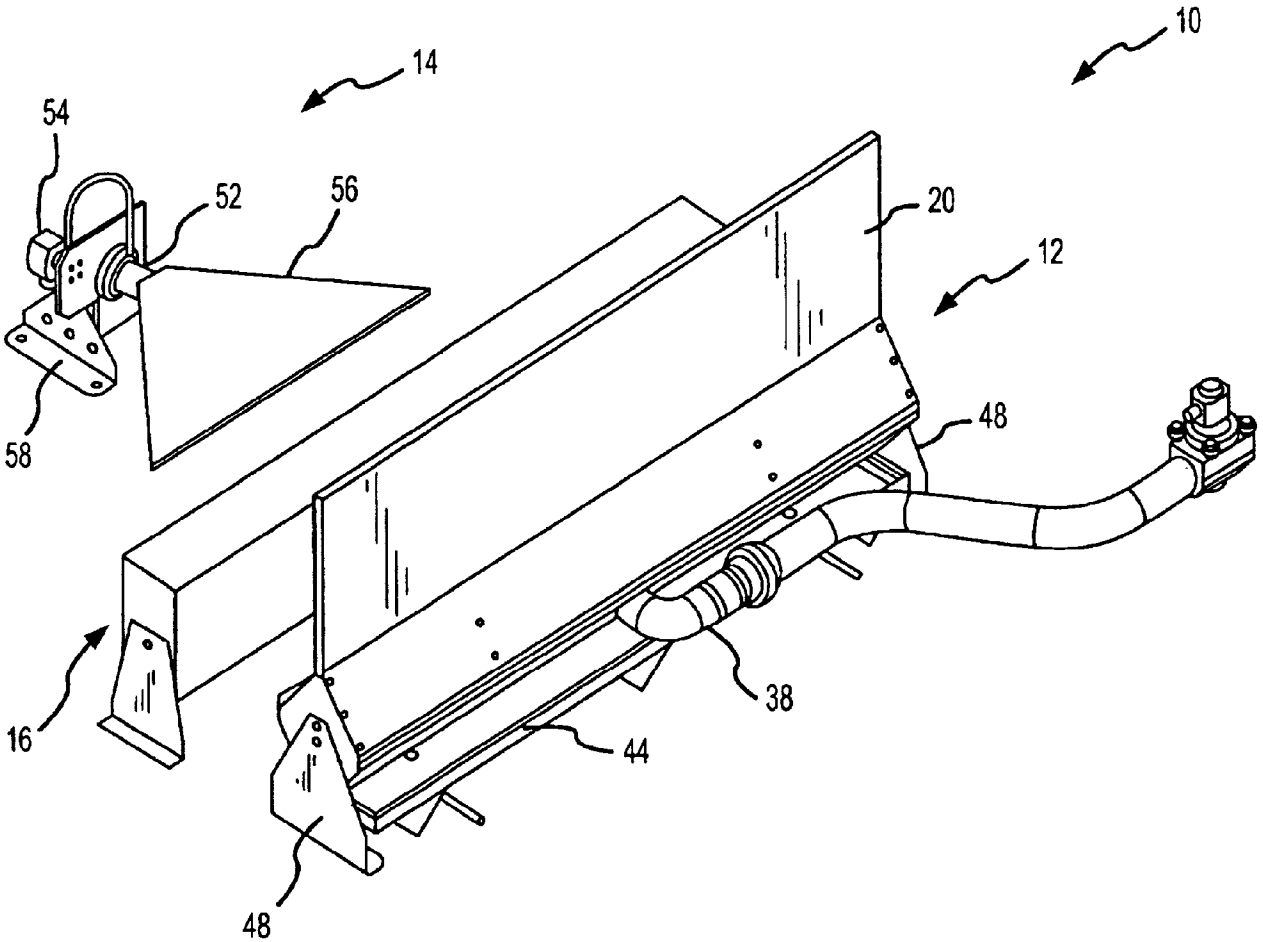
FIG. 1 illustrates an embodiment of a special effect device for producing a simulated flame or fire effect using a steam curtain.
Figure 2A:
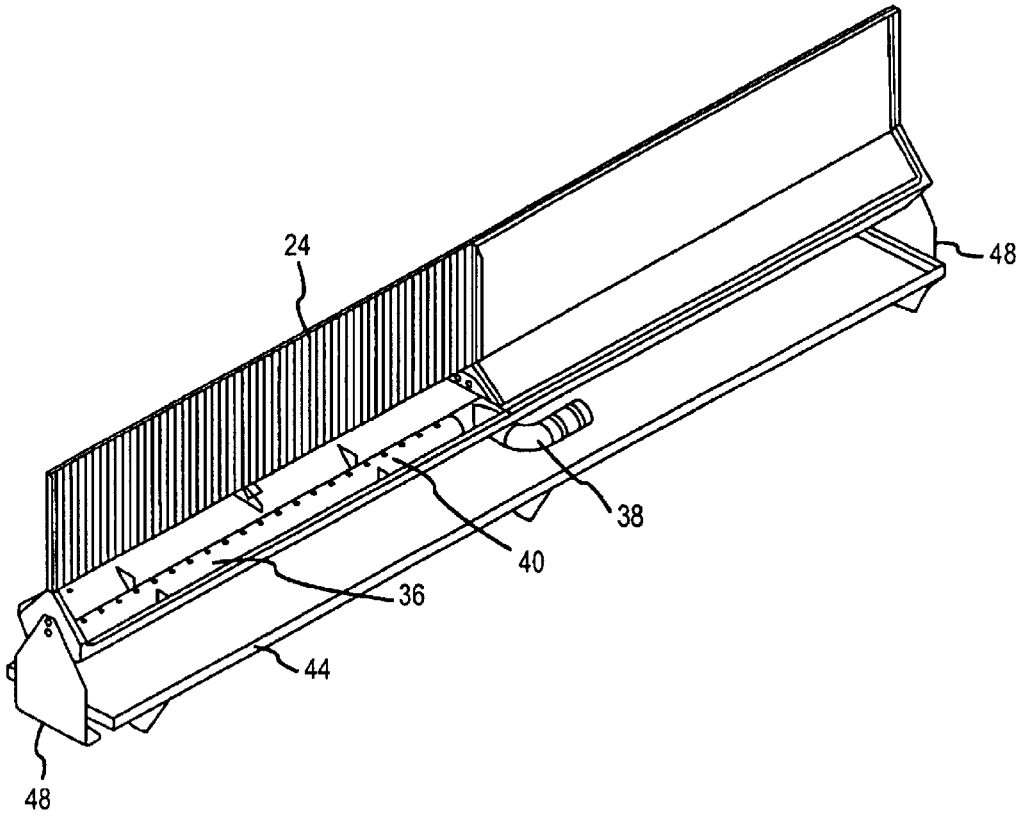
FIG. 2A is a cut away view of the steam console of the device shown in FIG. 1.
Figure 2B:
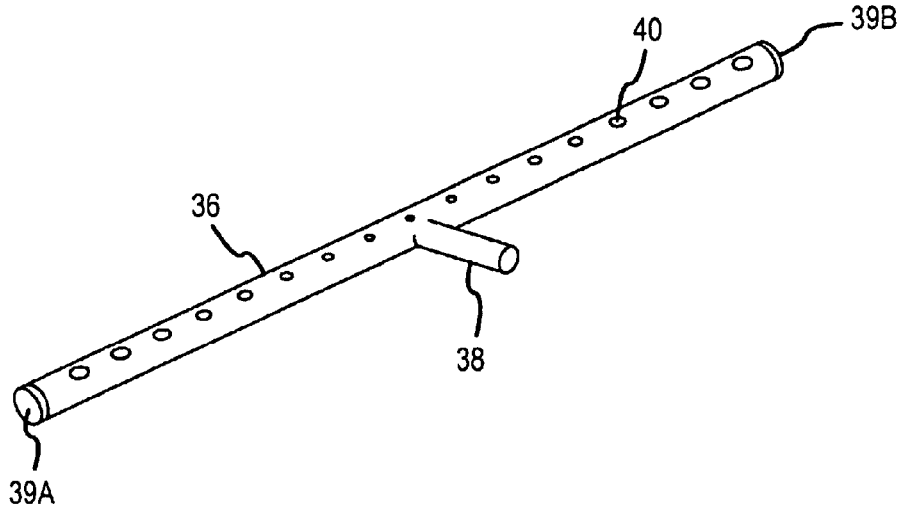
FIG. 2B is a perspective view of the steam emission manifold associated with the steam console of the device shown in FIG. 1.
Figure 3:
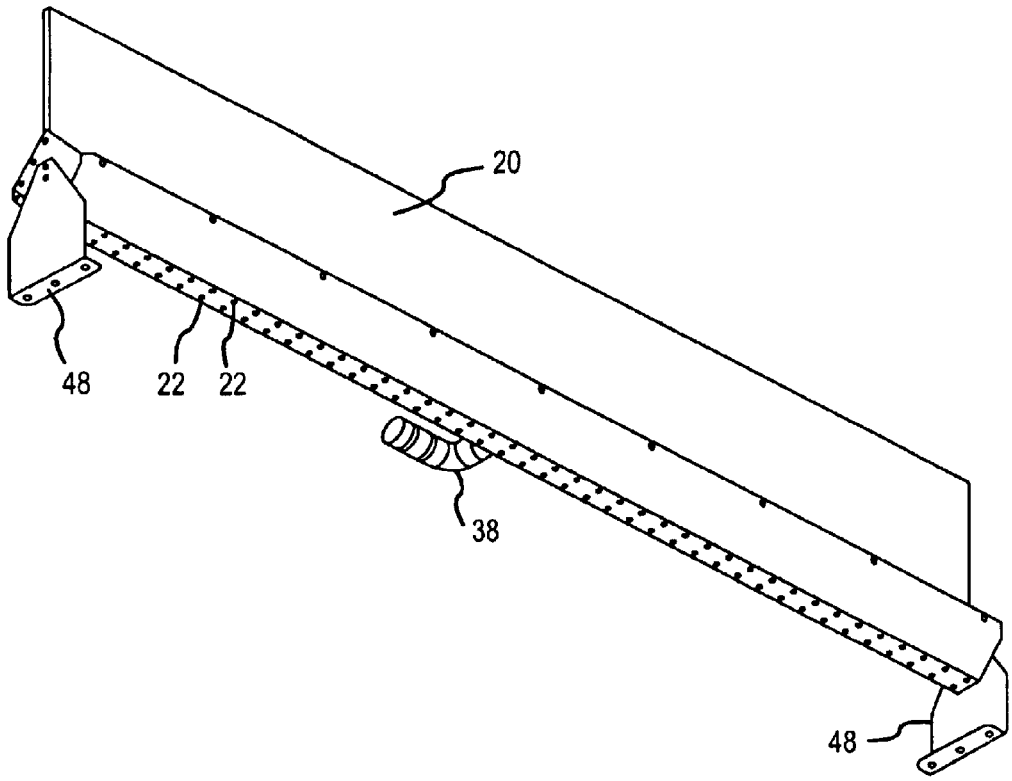
FIG. 3 is a bottom view of the steam console of the device shown in FIG. 1.
Figure 4:
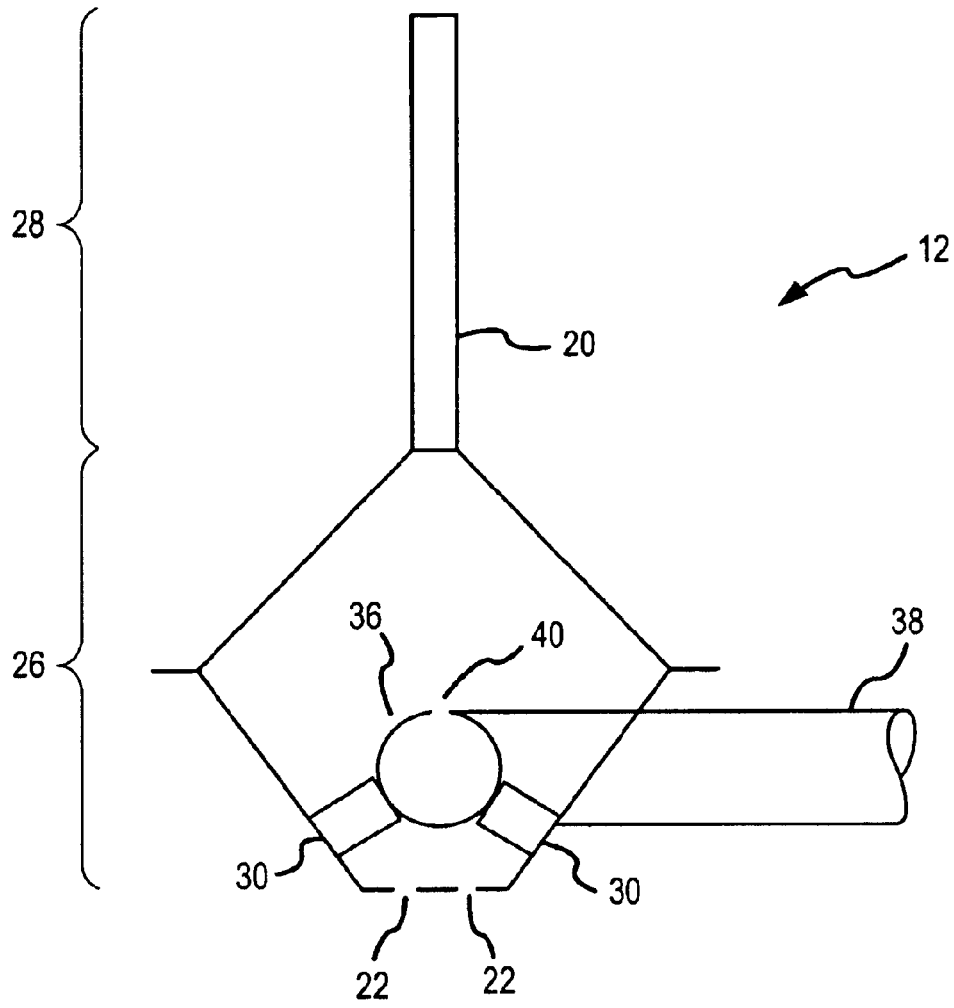
FIG. 4 is a cross-sectional view of the steam console shown in FIG. 1.

FIG. 1 illustrates an embodiment of the special effect device, which is hereinafter referred to as device 10, that uses steam to produce a simulated flame or fire effect. The device 10 comprises a steam console 12 for producing a curtain of steam of substantially uniform steam density along at least a portion of the length of the console, an air modulator 14 for modulating the curtain of steam of that is produced by the console 12, and a lighting assembly 16 for illuminating the modulated curtain of steam produced by the console 12 and air modulator 14 to achieve the simulated flame effect.

With reference to FIGS. 1–4, the steam console 12 comprises housing 20 for holding a steam emission manifold 22 and a flow straightener 24. The housing 20 defines a manifold portion 26 for holding the steam emission manifold 22 and an outlet slot portion 28 for holding the flow straightener 24. Both the manifold portion 26 and the outlet slot portion 28 extend for substantially the length of the console 12. In the illustrated embodiment, the width of the outlet slot portion 28 is Â½" to Â¾". However, the width can be varied if required by a particular application. The manifold portion 22 comprises several pairs of braces 30 for supporting the steam emission manifold 22. In addition, the manifold portion 22 has a number of air entrainment holes 32 that, during operation, allow air to enter the housing 20 and cool the steam being vented from the steam emission manifold to facilitate the production of the steam curtain adjacent to the outlet slot portion 28.

The steam emission manifold 22 comprises an elongated tube 36 that extends for substantially the entire length of the housing, an inlet port 38 for receiving steam produced by a boiler (not shown) and providing the received steam to the elongated tube 36, and a pair of end caps 39A, 39B that define the ends of the tube 36. The elongated tube 36 has a plurality of holes 40 for allowing steam to vent such that there is a substantially uniform distribution of steam along the length of the tube 36. The substantially uniform distribution of steam is achieved by spacing and/or sizing the holes such that the profile of the resistance of the holes to the flow of steam decreases as the distance from the inlet port 38 increases. In the illustrated embodiment, the distance between adjacent holes is substantially constant. However, the size or diameter of the holes increases with increasing distance from the inlet port 38. In an alternative embodiment, the size or diameter of each of the holes is substantially the same, but the distance between adjacent holes decreases with increasing distance from the inlet port 38. In yet a further embodiment, both the distance between adjacent holes and the size/diameter of the holes vary with the distance from the inlet port 38. The spacing and size of the holes can also be tailored to facilitate the production of a steam curtain with varying steam density (e.g., greater steam density in the middle of the console and lesser density at the ends of the console).

The holes 40 facilitate the production of a tall steam curtain adjacent to the outlet slot portion 28 of the housing. To elaborate, in an embodiment of a steam emission manifold that uses a nozzle instead of a hole, the structure of the nozzle typically requires the steam to change direction between the elongated tube and the exit port of the nozzle. In the case of a fan nozzle, the steam typically has to travel around a 90 degree bend in passing between the elongated tube and the exit port of such a nozzle. Such changes in direction reduce the velocity of the steam being vented from the steam emission manifold and, as a consequence, reduce the height of the steam curtain produced adjacent to the outlet slot portion of the housing. In contrast, a hole does not require the steam to change direction and, therefore, facilitates the production of a tall curtain of steam.

The elongated tube 36 is oriented in the housing 20 such that the plurality of holes 40 lie along a substantially straight line that lies substantially in a plane defined by the outlet slot portion 28. This orientation of the holes 40 relative to the outlet slot portion 28 also facilitates the production of a tall curtain of steam. To elaborate, in an embodiment in which the venting structure associated with the steam emission manifold does not vent the steam in the plane defined by the outlet slot portion, the steam is required to change directions between the vent and the outlet slot portion. This change in direction reduces the velocity of the steam and, relatedly, the height of the curtain of steam produced adjacent to the outlet slot portion 28. In contrast, by locating the holes 40 substantially directly under the outlet slot portion 28, the steam venting from the holes 40 follows a substantially straight path between the holes 40 and the outlet slot portion 28. Consequently, the steam does not have to change direction and the velocity of the steam exiting the outlet portion 28 is greater than it would be if the steam had to change direction. This greater velocity, in turn, facilitates the production of a tall curtain of steam.

Figure 5A:
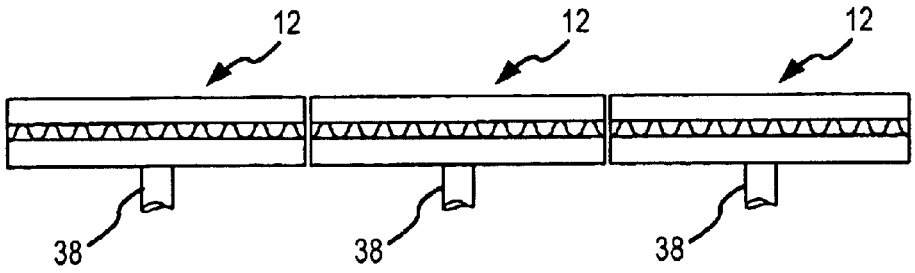
FIGS. 5A–5C respectively illustrate a series of consoles of the type shown in FIG. 1 located end-to-end, a console of the type shown in FIG. 1 located end-to-end with a console having an inlet port situated at the end of the console, and a console of the type shown in FIG. 1 located end-to-end with consoles that each have an inlet port situated at the end of the console.
Figure 5B:
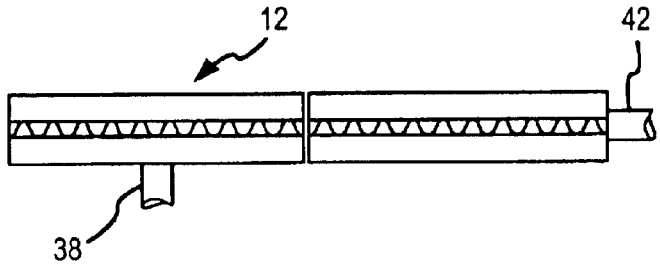
Figure 5C:
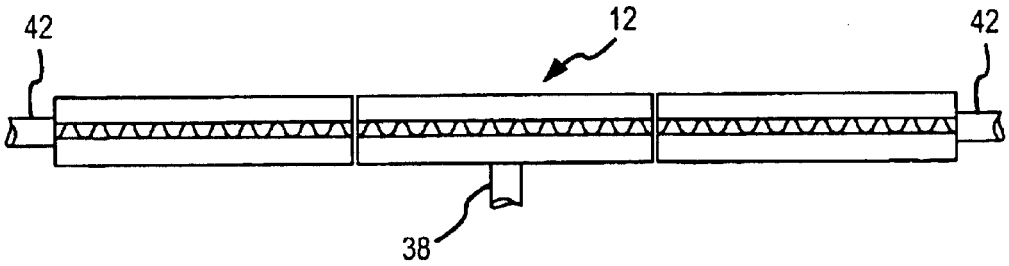

The inlet port 28 is located between the ends of the elongated tube 36. In the illustrated embodiment, the inlet port 28 is located at substantially the mid-point between the ends of the tube 36. By locating the inlet port 28 between the ends of the tube 36, the console 12 can be placed end-to-end with one or more consoles with similarly located inlet ports to achieve a substantially continuous simulated flame or fire effect over the length of the consoles, as shown in FIG. 5A. Alternatively, the console 12 is placed end-to-end with a console that has an inlet port 42 located at one end of its steam emission manifold to achieve a substantially continuous simulated flame effect over the length of the two consoles, as shown in FIG. 5B. In yet another alternative, the console 12 is placed end-to-end with two consoles that each have an inlet port 42 located at one end of a steam emission manifold to achieve a simulated flame or fire effect over the length of three consoles, as shown in FIG. 5C. The inlet port 28 can be placed at locations between the ends of the tube 36 other than the mid-point and still provide the ability to place the console 12 end-to-end with other consoles. Generally, however, if a steam curtain is to be produced along the length of the console 12, the location of the inlet port 28 is chosen so as not to interfere with the venting of steam from the tube 36. Further, it should be appreciated that the location of the inlet port 28 impacts the distribution and/or sizing of the holes 40 if a uniform steam density or varied steam density profile is desired. In addition, it should also be appreciate that by placing the inlet port 28 between the ends of the elongated tube 36, the design of a fire special effect that requires a string of consoles is significantly simplified. To elaborate, by locating the inlet port 28 between the ends of the elongated tube 36, a uniform or desired steam density for the console 12 can be designed without having to take into account the effect of other consoles in a string of consoles.

Figure 6A:
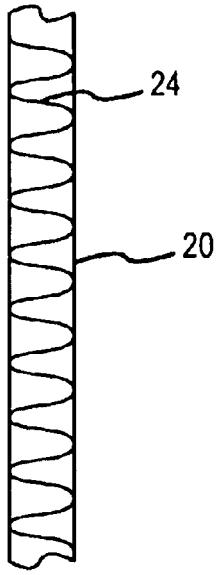
FIG. 6 illustrates two possible types of flow straighteners for use in the steam console shown in FIG. 1.
Figure 6B:
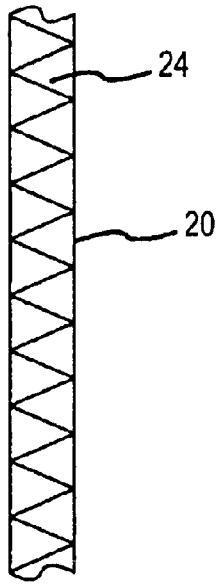

The flow straightener 24, absent the application of the air modulator 14, facilitates the production of a relatively smooth curtain of steam, i.e., the steam adjacent to the outlet slot portion 28 flows substantially directly upward. The flow straightener 24 also strives to reduce condensation that, in turn, reduces the amount of steam available to produce the curtain of steam. To elaborate, a flow straightener in the form of "honeycomb" (hexagonal cells) has a relatively high surface area that promotes condensation and, as a consequence, reduces the steam available to produce the curtain of steam. By utilizing a flow straightener with less surface area relative to a "honeycomb" flow straightener, condensation is reduced. Two possible configuration for the flow straightener 24 that have less surface area than a hexagonal flow straightener are the sinusoidal or triangular configuration respectively shown in FIGS. 6A and 6B. Other configurations are also feasible. The flow straightener 24 is preferably made of stainless steel, which has been found to be easier to clean and capable of withstanding the heat of the steam. However, other materials, such as plastic and fiberglass, are also feasible.

The steam console 12 further comprises condensate collection tray 44 for collecting water that condenses within the housing 20 and flows out the air entrainment holes 32 of the housing. In certain applications, the condensate collection tray 44 is not needed. For example, if the housing 20 is located on a floor or substrate that is capable of draining water, the condensate collection tray 44 may not be necessary.

The steam console 12 also comprises a pair of brackets 48 for attaching the housing 20 to a floor, substrate or frame.

The air modulator 14 produces a varying sheet-like current of moving air that is directed at the curtain of steam produced by the steam console 12. The air modulator 14 is comprised of a fan 52 (e.g., blower, squirrel-cage blower, shaded pole blowers etc.), an electromechanical device 52 for modulating the stream of air produced by the fan 52, and a fan nozzle for distributing the modulated air substantially across the extent of the outlet slot portion 28. A bracket assembly 58 facilitates attachment of the air modulator 14 to a floor, substrate or frame. In the illustrate embodiment, the electromechanical device 52 is a device that rotates a disk with one or more holes in front of the intake of the fan 54 to facilitate the production of the varying current of moving air. Other for varying the flow of air on the intake or output side of the fan 52 or similar device are feasible. As an alternative to the fan 52, a compressed air driven "air amplifier" or air amplified blower/exhausters, such as those made by Coppus and Exair, can be used to produce the current of moving air.

Figure 7:
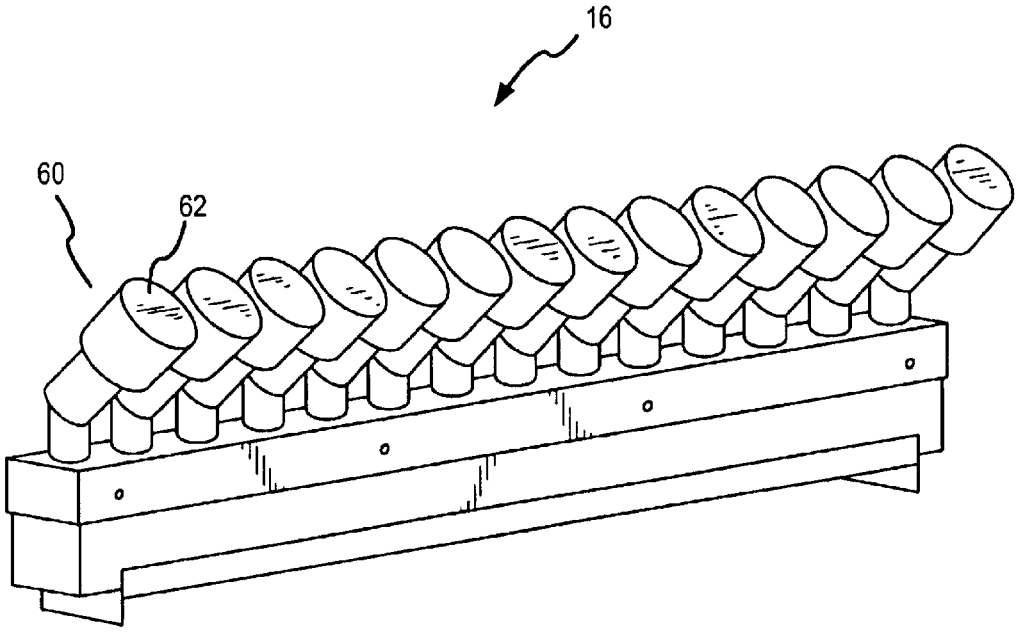
FIG. 7 illustrates the lighting assembly employed in the embodiment of the device shown in FIG. 1.

With reference to FIG. 7, the lighting assembly 16 produces the light that is directed to the modulated curtain of steam produced by the steam console 12 and air modulator 14 to produce the flame or fire special effect. The lighting assembly 16 is comprised of a lights 60 with each light having a colored filter 62. Each of the color filters is typically a combination of red, orange, yellow and sometimes blue color filters that are pieced together in a manner that when light is shown through them the colors of a flame are produced in a naturally occurring sequence, (e.g. red at the bottom, followed by orange, and yellow at the top). Flicker devices are used to modulate the intensity of the lights 60. In one embodiment, there is a flicker device associated with each of the lights 60 so that the lights to not flicker in synchronism but rather flicker in a quasi-random manner.

Other lighting structures are also feasible. For example, a lighting structure that employs different colored lights is feasible. Further, any lighting assembly is capable of being adapted to facilitate the production of flame or fire images of colors other than the previously noted red, orange, yellow and blue colors. For example, a lighting assembly can be adapted for the production of a flame or fire image in which the image is comprised of various shades of green. Yet another possible lighting structure is a projector that, during operation, projects a video image of a fire onto the screen.

Figure 8A:
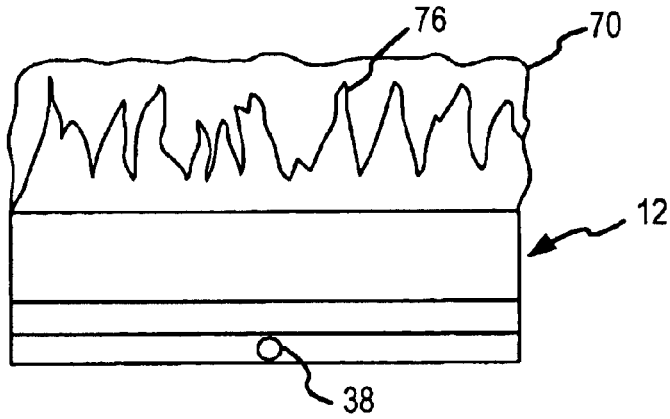
FIGS. 8A–8C respectively are rear, side and top views of the device shown in FIG. 1.
Figure 8B:
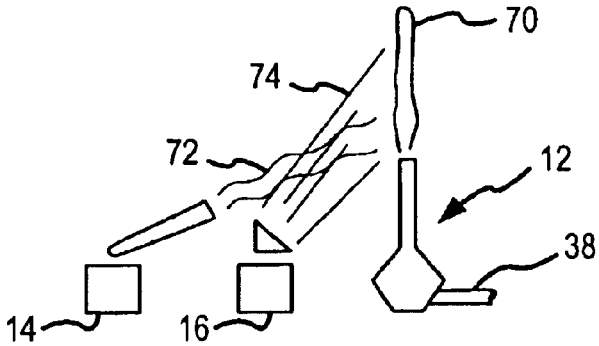
Figure 8C:
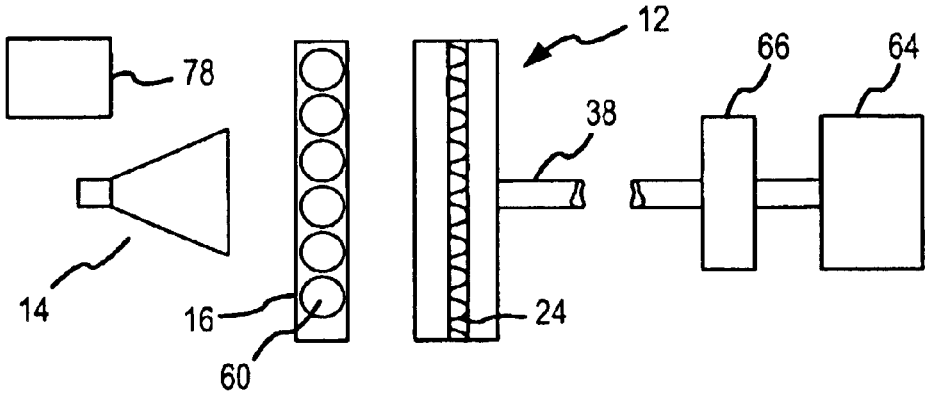

With reference to FIGS. 8A–8C, the operation of the device 10 is described. A boiler 64 produces the steam that is used by the console 12 to produce a steam curtain. Typically, the pressure of the steam produced by the boiler 64 is 2–5 psi. However, the device 10 can be adapted to operate at other pressure ranges, if needed. A main manifold 66 serves to output the steam produced by the boiler 64 to one or more of the consoles 12 at substantially equal and desired pressures for operation of the consoles 12. Provided the steam lines between the main manifold 66 and each of the consoles present substantially equal thermodynamic losses, the consoles 12 each receive steam at substantially the same pressure and temperature. In the embodiment illustrated in FIGS. 8A–8C, since there is only one console 12, the main manifold 66 could be eliminated if the boiler 64 is susceptible to appropriate regulation.

In any event, the steam produced by the boiler 64 is received at the inlet port 38 of the console 12 and distributed along the length of the elongated tube 36. The steam is vented from the tube 36 via the holes 40 such that there is substantially even distribution of steam along the length of the tube 36. The steam venting from the holes 40 mixes with the relatively cooler air that is entering the manifold portion 26 of the housing 20 by the air entrainment holes 32. The mixing of the steam with the cooler air promotes condensation and the densification of the resulting "steam" curtain produced adjacent to the outlet slot portion 28. After mixing with the cooler air, the steam passes through the flow straightener 24 and exits the console adjacent to the outlet slot portion 28. Absent the operation of the air modulator 14, a steam/fog curtain 70 is produced adjacent to the outlet slot portion 28.

The mixing of the steam vented from the tube 36 with the cooler air and flow straightener 24 promote condensation that results in some of the steam being converted to water droplets that are too massive to be ejected from the outlet slot portion 28 of the housing 20. Many of these water droplets drain through the air entrainment holes 32 and are collected in the condensation tray 44.

The air modulator 14 produces a varying current of air 72 that modulates the curtain of steam/fog produced by the console 12 in a manner that closely simulates the action of a flame or fire.

The lighting assembly 16 produces a flood of light 74 that interacts with the modulated steam/fog curtain produced by the operation of the console 12 and the air modulator 14 to produce a simulated flame or fire effect 76.

A control and electrical power distribution system 78 distributes power to the air modulator 14 and the lighting assembly 16. The system 78 also includes the electronic circuitry for causing the lights of the lighting assembly to flicker or change in intensity. Further, the system 78 controls a solenoid 80 (FIG. 1) that permits a user to selectively or controllably apply steam from the boiler 64 to the console 12. The ability to control the application of steam to the console 12 also impacts the height of the resulting curtain of steam, i.e., the greater the pressure of the steam applied to the console 12, the greater the height of the resulting curtain of steam produced adjacent to the outlet slot portion 28.

A number of modifications to the device 10, in addition to any already noted, are feasible. For instance, the air entrainment holes 32 could be eliminated and a steam/fog curtain produced. However, without the pre-cooling of the air that enters through the holes 32, the cooling of the steam would primarily occur after the steam was vented from the outlet slot portion 28. As a consequence, the steam/fog curtain would form further from the outlet slot portion 28 than it would otherwise, which may be undesirable in certain applications. The relative positions of the console 12, air modulator 14 and lighting assembly 16 can be changed from those shown in the drawings to address particular applications of the device 10. Further, while many of the elements of the console 12 are linear in nature, curved elements are also feasible. For example, a curved tube can replace the tube 36. Further, the holes along such a curved tube for venting the steam can be positioned to lie in a curved plane that is defined by a curved outlet slot portion that houses a curved flow straightener. Another possible modification is to use a slot rather than the holes 40 to achieve the desired profile for resistance to the flow of steam.

A further embodiment of a special effect device that produces a simulated flame or fire effect utilizes theatrical smoke, rather than steam. Generally, the device includes a console for producing a curtain of theatrical smoke that has a substantially constant or uniform density along at least a portion of the length of the console, an air modulator for modulating the curtain of theatrical smoke produced by the console, and a lighting assembly for illuminating the curtain of theatrical smoke produced by the console. In operation, illumination of the modulated curtain of theatrical smoke produced by the console and the air modulator produces a simulated flame effect.

Figure 9:
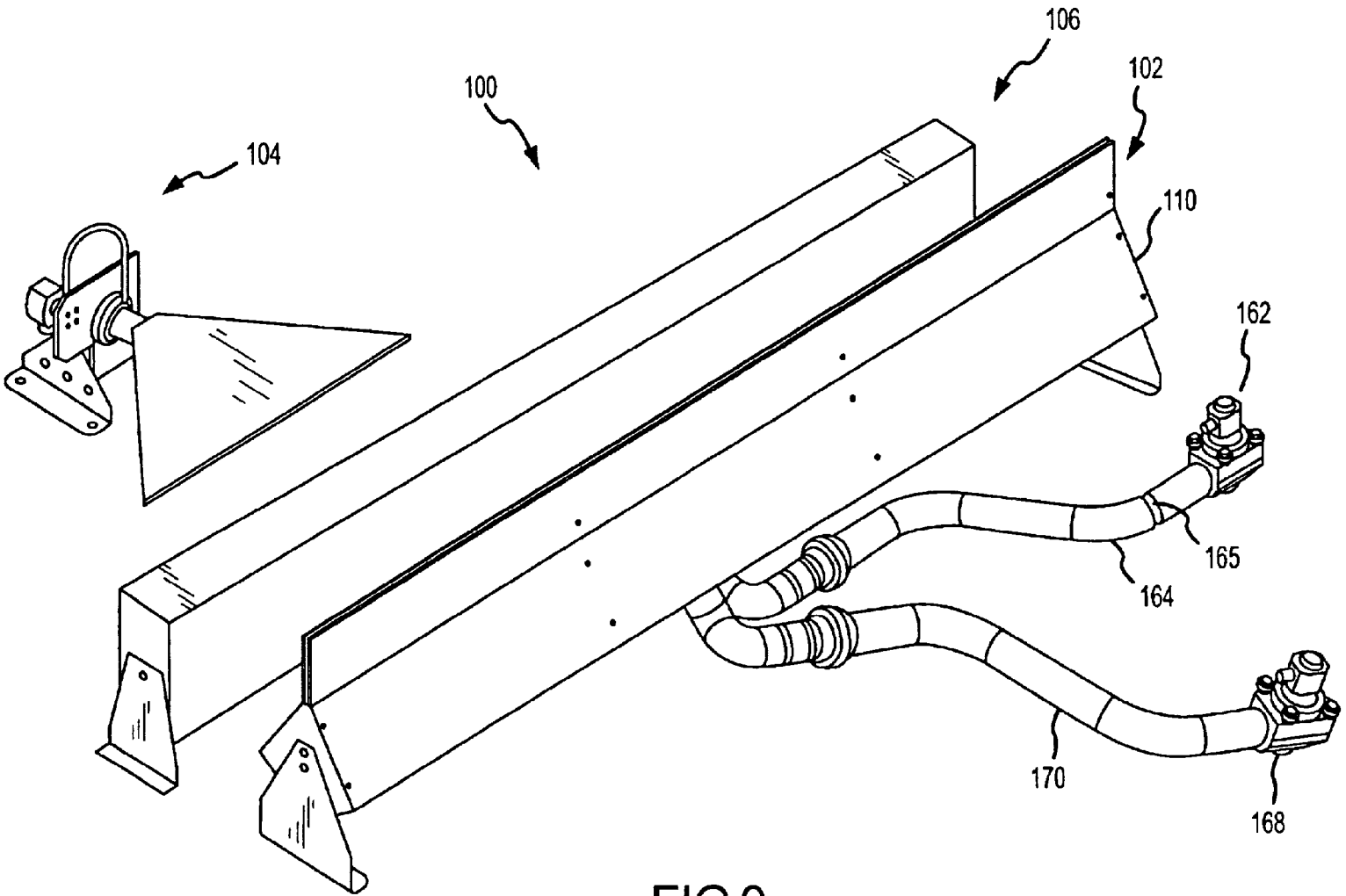
FIG. 9 illustrates an embodiment of a special effect device for producing a simulated flame or fire effect using theatrical smoke.

FIG. 9 illustrates an embodiment of the special effect device, which is hereinafter referred to as device 100, that uses theatrical smoke to produce a simulated flame or fire effect. The device 100 comprises a theatrical smoke console 102 for producing a curtain of theatrical smoke of substantially uniform theatrical smoke density along at least a portion of the length of the console, an air modulator 104 for modulating the curtain of theatrical smoke that is produced by the console 102, and a lighting assembly 106 for illuminating the modulated curtain of theatrical smoke produced by the console 102 and air modulator 104 to achieve the simulated flame effect.

Figure 10:
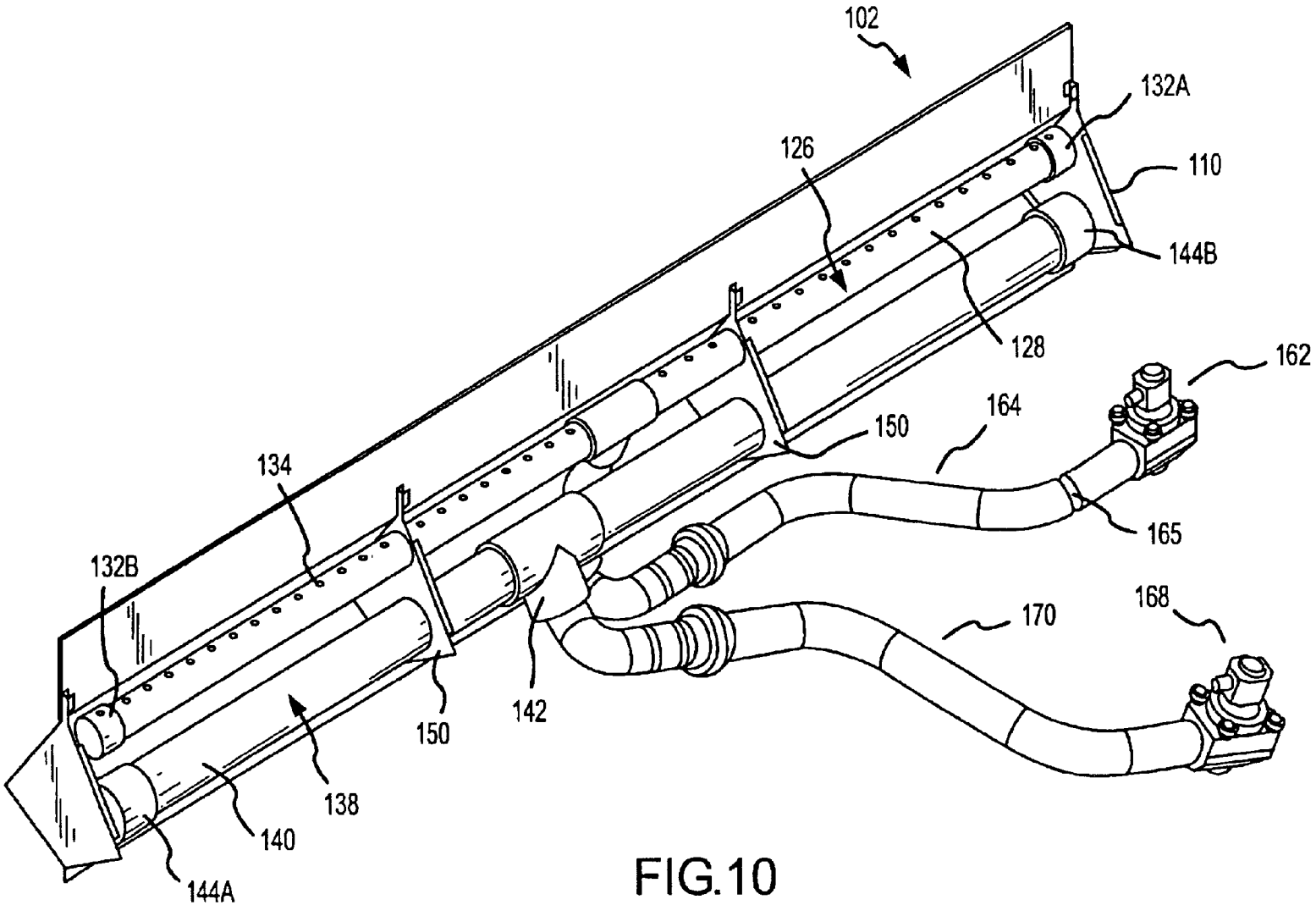
FIG. 10 is a cut away view of the theatrical smoke console of the device shown in FIG. 9.
Figure 11:
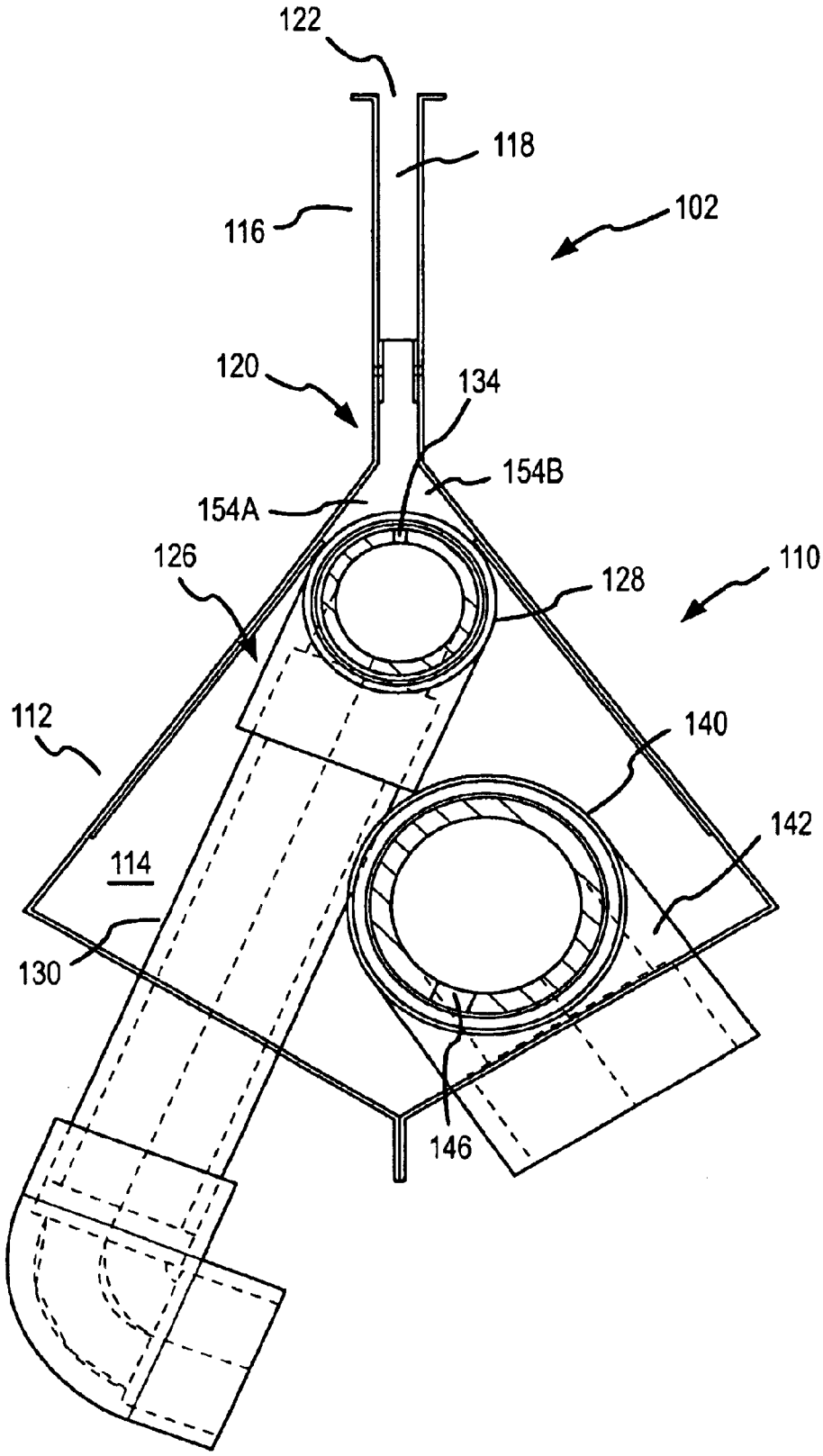
FIG. 11 is a cross-sectional view of the theatrical smoke console shown in FIG. 9.
Figure 1:
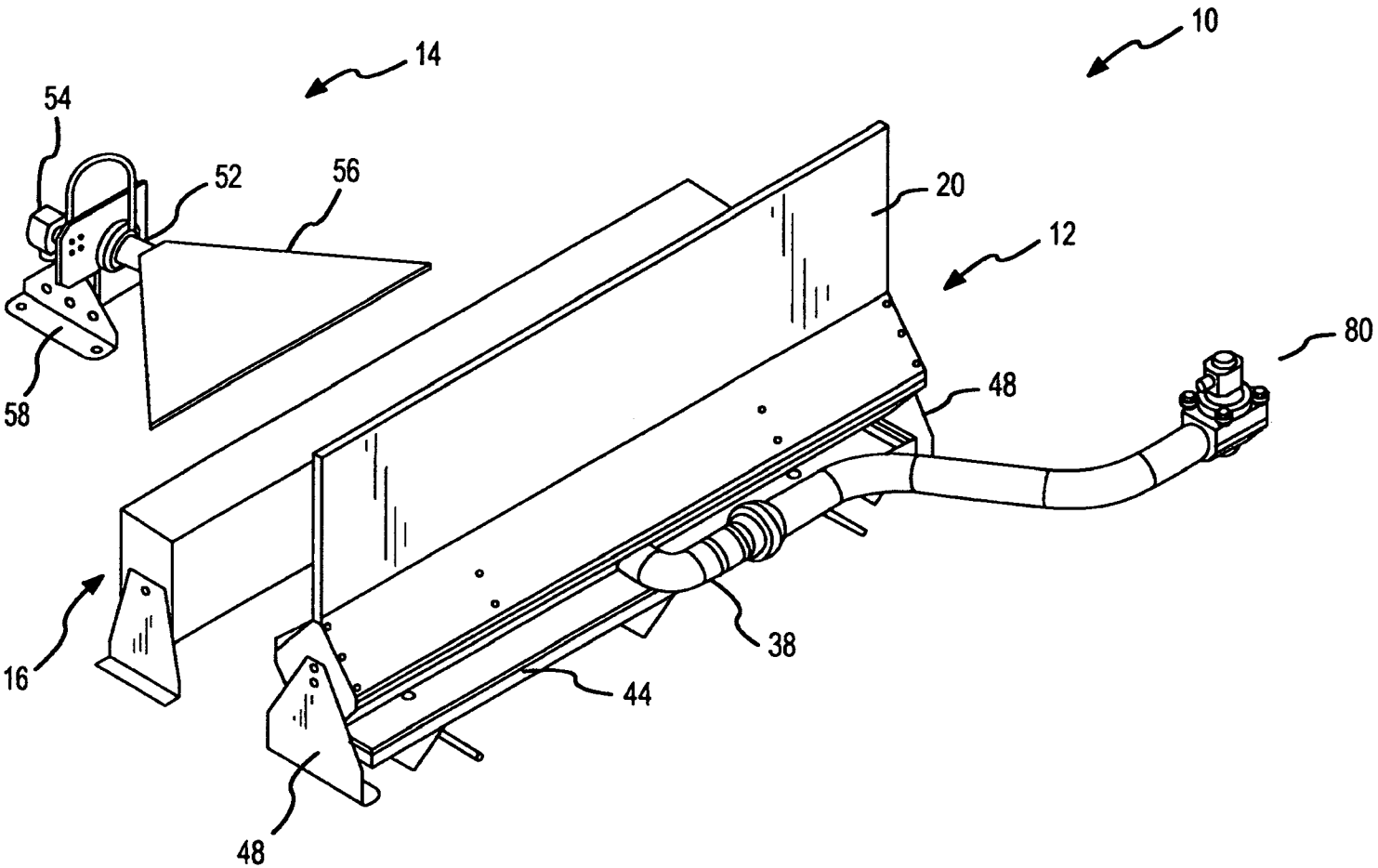
Figure 2B:
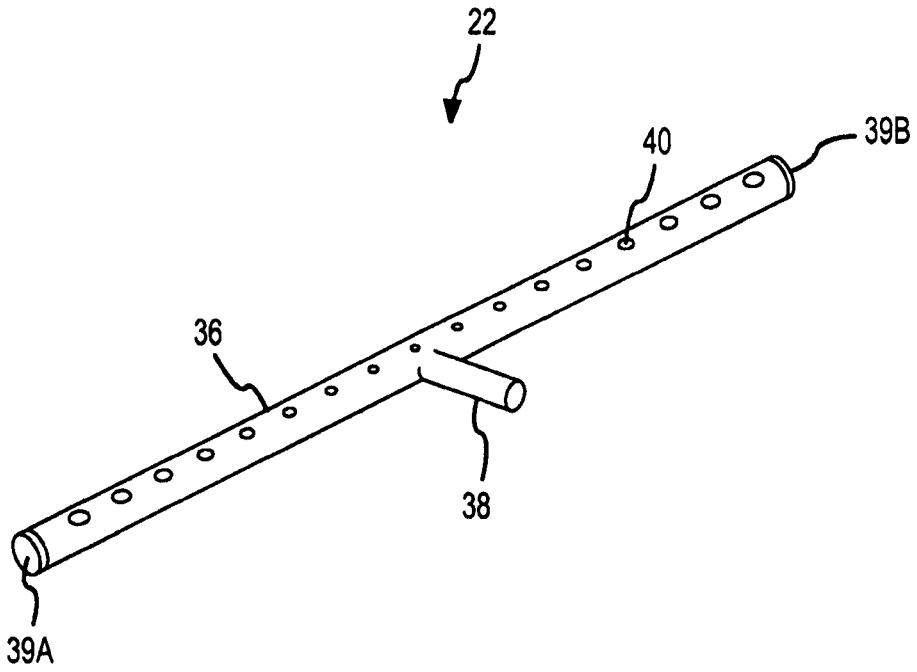
Figure 3:
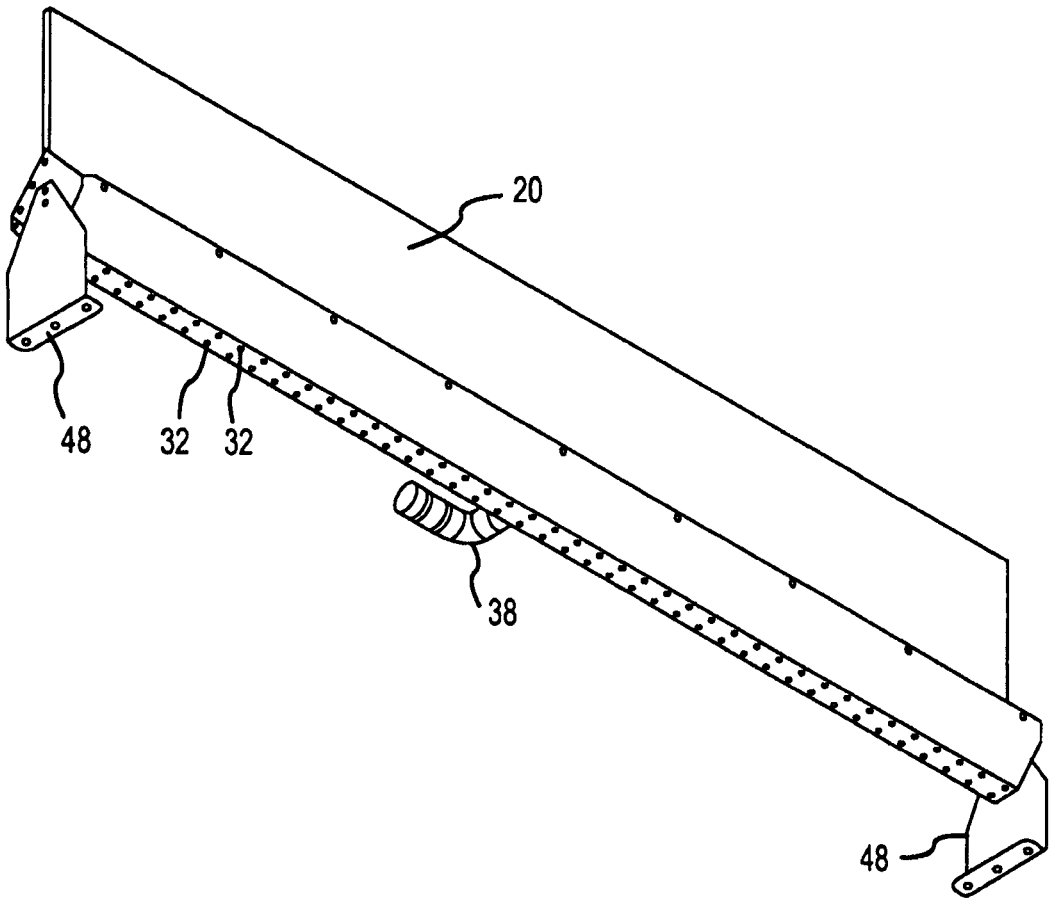
Figure 4:
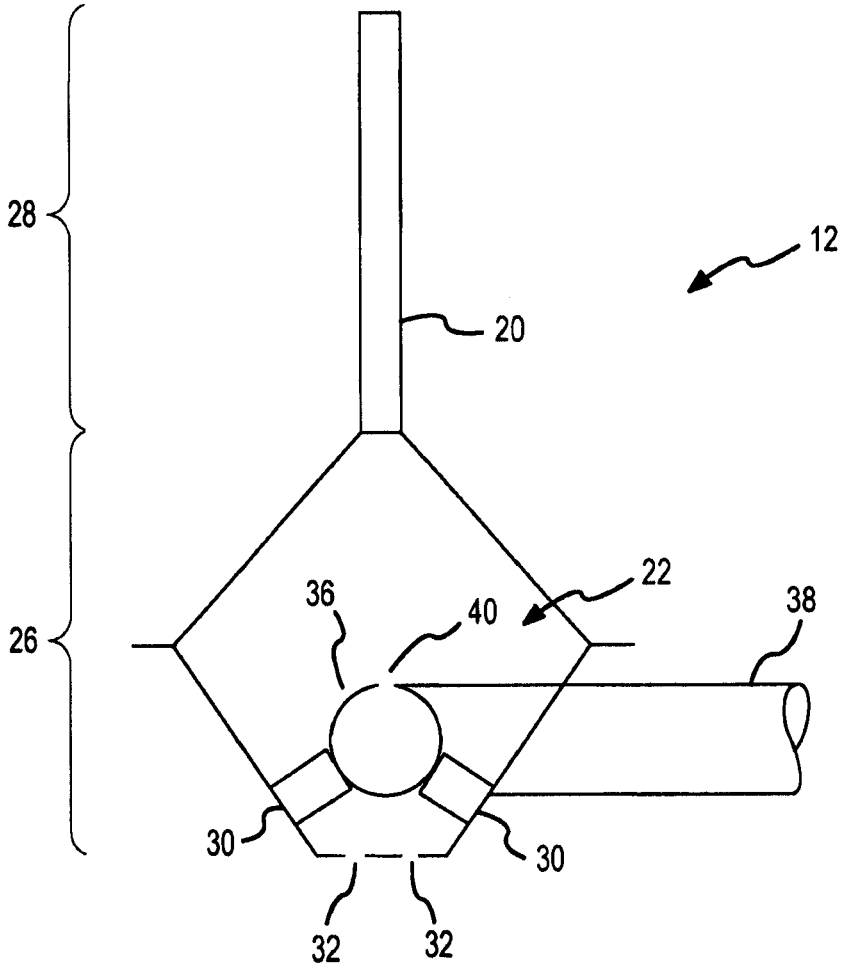
Figure 9:
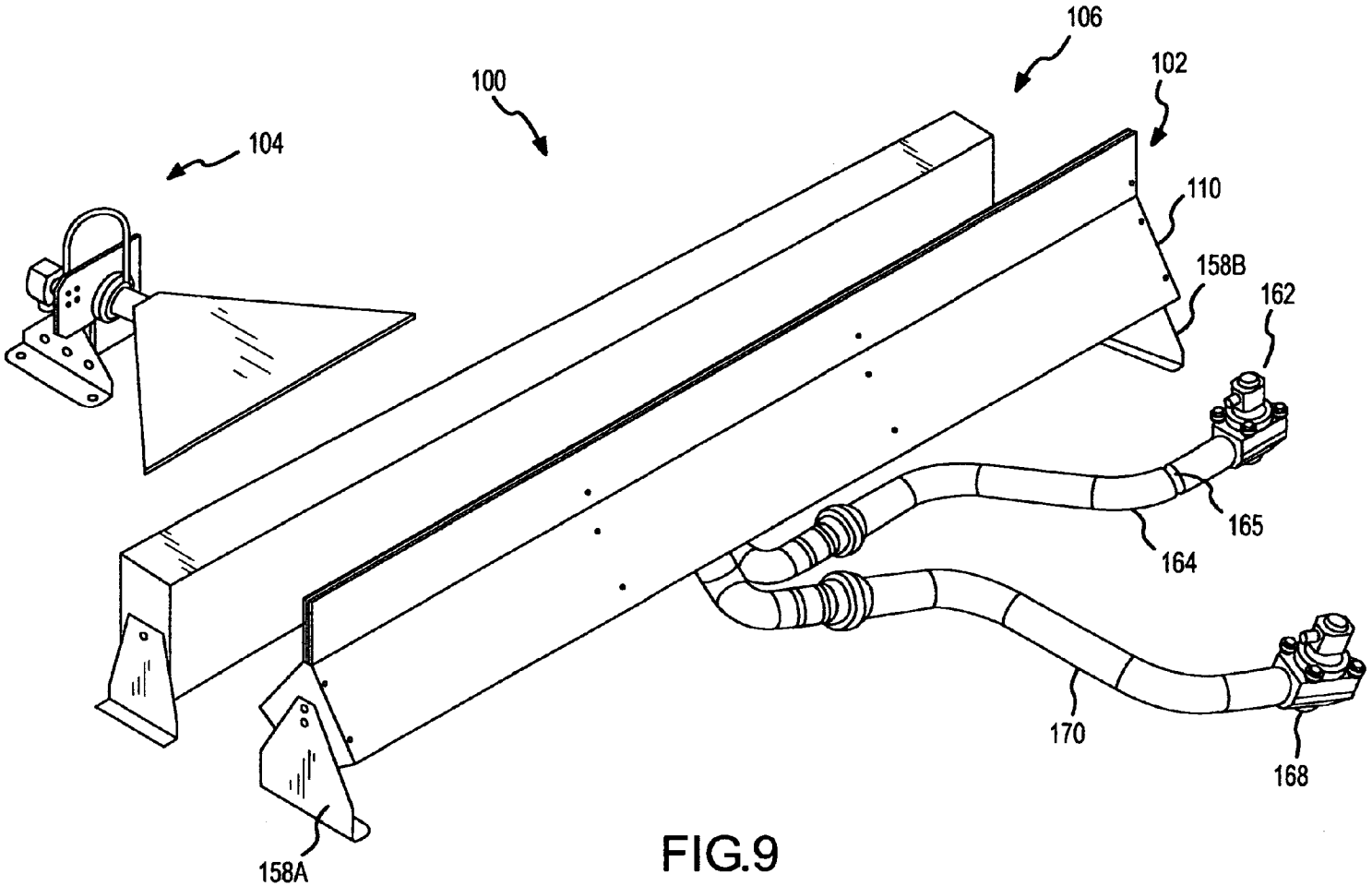

With reference to FIGS. 9–11, the theatrical smoke console 102 comprises a housing 110 that is shaped so as to direct a gas (typically, air) and entrained theatrical smoke so as to form a curtain of theatrical smoke. The housing 110 comprises a first portion 112 that defines a chamber 114 and a second portion 116 that defines a slot 118. The slot 118 extends from a slot/chamber junction 120 to an outlet port 122.

The first portion 112 of the housing 110 is a substantially closed surface that forms a plenum within which sufficient gas pressure can be produced to push or direct at least some of the gas through slot 118. Alternatively, a perforated or open surface can be used to funnel or direct gas from a blower such that at least a portion of the gas flows through the slot 118. In the illustrated embodiment, the first portion 112 extends the length of the console 102 to facilitate the production of a substantially continuous simulated flame when two or more consoles are cascaded together. If such an effect is not needed, the first portion 112 need not extend the length of the console 112. The first portion 112 also has a diamond-like cross-section that is approximately 8" wide and 8" high. Other shapes and dimensions are feasible. Further, the first portion 112 extends between the ends of a console 102 along a substantially straight line. If needed, the first portion 112 can be fabricated to follow a curved path or a path that is a combination of straight and curved sections.

The second portion 116 of the housing 110, which defines the slot 118 through which the gas and entrained smoke pass, serves to shape the gas and entrained smoke so that a curtain of theatrical smoke is formed above the outlet port 122. The height of the slot 118 is a compromise between having a slot of sufficient length to form a suitable curtain and the need to limit the mixing of the gas and the theatrical smoke to prevent dilution of the theatrical smoke. In the illustrated embodiment, the height of the slot 118 is approximately 4". Other height slots are also feasible. The width of the slot 118 is also chosen so as that a suitable curtain is formed. In the illustrated embodiment, the width of the slot is approximately ⅜". A slot with a different width is also feasible. The slot 118 extends the length of the console 102 to facilitate the production of a substantially continuous flame when two or more consoles are cascaded together. If such an effect is not needed, the second portion 116 need not extend the length of the console 102. Further the second portion 116 extends between the ends of the console 102 along a substantially straight line. If needed, the second portion 116 can be fabricated to follow a curved path or a path that is a combination of straight and curved sections.

The console 102 is further comprised of a theatrical smoke emission manifold 126 for providing the theatrical smoke to the interior of the housing 110. The manifold 126 comprises an elongated tube 128, an inlet port 130 for receiving theatrical smoke produced by a theatrical smoke generator (not shown) and providing the received theatrical smoke to the elongated tube 128, and a pair of end caps 132A, 132B that define the ends of the tube 128. The elongated tube 128 has a plurality of holes 134 for allowing theatrical smoke to vent such that there is a substantially uniform distribution of theatrical smoke along the length of the tube 128. The substantially uniform distribution of theatrical smoke is achieved by spacing and/or sizing the holes 134 such that the profile of the resistance of the holes to the flow of theatrical smoke decreases as the distance from the inlet port 130 increases. For a substantially constant distance between adjacent holes, a substantially uniform distribution of theatrical smoke is achieved when the size or diameter of the holes increases with increasing distance from the inlet port 130. In an alternative embodiment, the size or diameter of each of the holes is substantially the same, but the distance between adjacent holes decreases with increasing distance from the inlet port 130. In yet a further embodiment, both the distance between adjacent holes and the size/diameter of the holes vary with the distance from the inlet port 130. In the illustrated embodiment, a substantially uniform distribution of theatrical smoke is achieved with a substantially constant distance between adjacent holes and a substantially constant hole size. To elaborate, both the length of the manifold 126 and the anticipated pressure of the theatrical smoke within the manifold 126 are substantial factors in determining the distance between adjacent holes and the size of the holes needed to achieve a substantially uniform distribution of theatrical smoke. In the illustrated embodiment, the manifold 126 is relatively short and the pressure of theatrical smoke is expected to be relatively high. In such a case, a substantially uniform distribution of theatrical smoke is achievable with substantially constant spacing between adjacent holes and holes of substantially constant size. The spacing and size of the holes can also be tailored to facilitate the production of a theatrical smoke curtain with varying theatrical smoke density (e.g., greater theatrical smoke density in the middle of the console and lesser density at the ends of the console).

The tube 128 extends the length of the console 102 to facilitate the production of a substantially continuous simulated flame when two or more consoles are cascaded together. If such an effect is not needed, the tube 128 need not extend the length of the console 112. In the illustrated embodiment, the tube 128 has a circular cross-section and a diameter of 2". Tubes with different cross-sectional shapes and dimensions are also feasible. Further the tube 128 extends between the ends of the console 102 along a substantially straight line. If needed, the tube 128 can be fabricated to follow a curved path or a path that is a combination of straight and curved sections.

The console 102 is further comprised of a gas emission manifold 138 for providing the gas (typically, air) to the interior of the housing 110 that is used to create a stream of gas for transporting the theatrical smoke provided by manifold 126 to the outlet port 122. The manifold 138 comprises an elongated tube 140, an inlet port 142 for receiving gas produced by a gas generator (not shown), such as a blower or fan, and providing the received gas to the elongated tube 140, and a pair of end caps 144A, 144B that define the ends of the tube 140. The elongated tube 140 has a plurality of holes 146 that extend along the length of the tube 140 for allowing gas to vent such that there is a substantially uniform distribution of gas along the length of the tube 128. The substantially uniform distribution of gas is achieved by spacing and/or sizing the holes 146 such that the profile of the resistance of the holes to the flow of gas decreases as the distance from the inlet port 142 increases. For a substantially constant distance between adjacent holes, a substantially uniform distribution of gas is achieved when the size or diameter of the holes increases with increasing distance from the inlet port 142. In an alternative embodiment, the size or diameter of each of the holes is substantially the same, but the distance between adjacent holes decreases with increasing distance from the inlet port 142. In yet a further embodiment, both the distance between adjacent holes and the size/diameter of the holes vary with the distance from the inlet port 142. In the illustrated embodiment, a substantially uniform distribution of gas is achieved with a substantially constant distance between adjacent holes and a substantially constant hole size. To elaborate, both the length of the manifold 138 and the anticipated pressure of the gas within the manifold 138 are substantial factors in determining the distance between adjacent holes and the size of the holes needed to achieve a substantially uniform distribution of gas. In the illustrated embodiment, the manifold 138 is relatively short and the pressure of the gas is expected to be relatively high. In such a case, a substantially uniform distribution of gas is achievable with substantially constant spacing between adjacent holes and holes of substantially constant size. The spacing and size of the holes can also be tailored to facilitate the production of a gas curtain with varying gas density (e.g., greater gas density in the middle of the console and lesser density at the ends of the console).

The tube 140 extends the length of the console 102 to facilitate the production of a substantially continuous simulated flame when two or more consoles are cascaded together. If such an effect is not needed, the tube 140 need not extend the length of the console 112. In the illustrated embodiment, the tube 140 has a circular cross-section and a diameter of 3". Tubes with different cross-sectional shapes and dimensions are also feasible. Further the tube 140 extends between the ends of the console 102 along a substantially straight line. If needed, the tube 140 can be fabricated to follow a curved path or a path that is a combination of straight and curved sections.

The inlet port 130 is located between the ends 132A, 132B of the elongated tube 128. Likewise, the inlet port 142 is located between the ends 144A, 144B of the elongated tube 140. In the illustrated embodiment, the inlet port 130 is located at substantially the mid-point between the ends 132A, 132B of the tube 128 and the inlet port 142 is located at substantially the mid-point between the ends 144A, 144B of the tube 140. By locating the inlet ports 130, 142 between the ends of their respective tubes, the console 102 can be placed end-to-end with one or more consoles with similarly located inlet ports to achieve a substantially continuous simulated flame or fire effect over the length of the consoles. This ability was illustrated with respect to the steam embodiment of the device in FIG. 5A. Alternatively, the console 102 is placed end-to-end with a console that has an inlet port that is located at one end of its gas emission manifold to achieve a substantially continuous simulated flame effect over the length of the two consoles. This ability was illustrated with respect to the steam embodiment of the device in FIG. 5B. In yet another alternative, the console 102 is placed end-to-end with two consoles that each have an inlet port located at one end of a gas emission manifold to achieve a simulated flame or fire effect over the length of three consoles. This ability was illustrated with respect to the steam embodiment of the device in FIG. 5C.

The inlet ports 130, 142 can each be placed at a location other than the mid-point of the tube with which each is associated and still provide the ability to place the console 102 end-to-end with other consoles. Generally, however, if a theatrical smoke curtain is to be produced along the length of the console 102, the location of the inlet ports is chosen so as not to interfere with the venting of theatrical smoke from the tube 128. Further, it should be appreciated that the location of the inlet port 130 impacts the distribution and/or sizing of the holes 134 if a gas stream with entrained theatrical smoke and a uniform or varied density profile is desired. Likewise, the location of the inlet port 142 impacts the distribution and/or sizing of the holes 146 if a gas stream with entrained theatrical smoke and a uniform or varied density profile is desired. In addition, it should also be appreciate that by placing the inlet ports 130, 142 between the ends of the elongated tube with which each is associated, the design of a fire special effect that requires a string of consoles is significantly simplified. To elaborate, by locating the inlet ports 130, 142 between the ends of the elongated tube with which each is associated, a console 102 that produces a gas stream with entrained theatrical smoke with a desired density profile can be designed without having to take into account the effect of other consoles in a string of consoles.

The theatrical smoke emission manifold 126 and the gas emission manifold 138 are supported within the housing 110 by mounting brackets 150. A separate mounting bracket or set of mounting brackets for each of the manifolds is also feasible.

The elongated tube 128 of the theatrical smoke emission manifold 126 and the elongated tube 140 of the gas emission manifold 138 are positioned within the housing so that the holes of the tube 128 are located between the outlet port 122 and the holes 146 of the tube 140. This positioning generally assures that the theatrical smoke output through the holes 134 of the theatrical smoke emission manifold 126 will enter a stream of gas that is headed to the output port 122 rather being entrained in a stream of turbulent gas that would dilute the theatrical smoke. In the illustrated embodiment, the tube 126 is positioned adjacent slot/chamber junction 120, a location at which substantially all of the gas moving by the tube 126 is likely to be headed to the output port 122. Further, the tube 128 is located such that a pair of flow paths 154A, 154B are defined that merge into the slot 118. Alternatively, depending upon the size of the tube 128 and the slot 118, the tube 128 can be located within the slot 118.

The elongated tube 128 of the theatrical smoke emission manifold 126 is also oriented within the housing 110 such that the plurality of holes 134 lie along a substantially straight line that lies substantially in a plane defined by the outlet slot 118. Further, the holes 134 are located so that the theatrical smoke exiting the holes 134 during operation flows in a substantially straight line towards the outlet port 122. This orientation of the holes 134 reduces the time that the theatrical smoke is entrained in the gas stream within the housing 110 and increases the height of the curtain that can be achieved adjacent to the outlet port 122.

The elongated tube 140 of the gas emission manifold 138 is oriented within the housing 110 such that the plurality of holes 146 face in a direction that allows the chamber 114 to create a substantially uniform gas pressure along the length of the chamber and, as a consequence, a relatively uniform flow through the slot 118. If the holes 146 directly faced the slot/chamber junction 120, the flow of gas through the slot would likely be non-uniform with more gas flowing in the portions of the slot 118 adjacent to a hole than and less gas flowing in the portions of the slot 118 between holes.

The theatrical smoke console 102 also comprises a pair of brackets 158 for attaching the housing 20 to a floor, substrate or frame.

The air modulator 104 produces a varying sheet-like current of moving air that is directed at the curtain of theatrical smoke produced by the theatrical smoke console 102. The air modulator 104 is substantially identical to the previously described air modulator 14. As a consequence, the air modulator 104 and alternatives thereto are not described further.

The lighting assembly 106 produces the light that is directed to the modulated curtain of theatrical smoke produced by the theatrical smoke console 12 and air modulator 14 to produce the flame or fire special effect. Since the lighting assembly 106 is substantially identical to the previously described lighting assembly 16, the lighting assembly 106 and alternatives thereto are not described further.

The operation of the device 100 involves using the console 102 to produce a curtain of theatrical smoke adjacent to the outlet port 122; using the air modulator 104 to produce a varying current of air that modulates the curtain of theatrical smoke produced by the console 102 in a manner that simulates the action of a flame or fire; and using the lighting assembly 106 to produce a flood of light that interacts with the modulated theatrical smoke curtain produced by the operation of the console 102 and the air modulator 104 to produce a simulated flame or fire effect.

The theatrical smoke provided to the console 102 of the device 100 is produced by a theatrical smoke machine 162 and conveyed to the console 102 by piping 164. For the theatrical smoke produced by the machine 162 to be conveyed by the piping 164 to the console 102, the machine 162 is not directly connected to the piping 164. Typically, there is a 3" to 5" gap 165 between the outlet of the machine 162 and the inlet of the piping 164. The amount of smoke produced by the machine 162 is typically varied using a control interface that is supplied with or part of the machine. A blower 168 produces the stream of gas that is provided to the console 102 via piping 170. The height of the curtain of theatrical smoke that is produced adjacent to the outlet port 122 of the console 102 is determined by the blower. If a constant output blower is utilized, the height of the curtain can be adjusted by blocking the blower intake. Alternatively, if a variable-speed blower is used, the height of the curtain can be adjusted by adjusting the speed of the blower.

A control and electrical power distribution system, similar to the system 78 used with the steam embodiment of the device, distributes power to the air modulator 104, the lighting assembly 106, smoke machine 162, and blower 164. The system also includes the electronic circuitry for causing the lights of the lighting assembly to flicker or change in intensity. Further, to the extent possible, the system allows a user to control the smoke machine 162 and the blower 164.

A number of modifications to the device 100, in addition to any already noted, are feasible. For instance, the relative positions of the console 102, air modulator 104 and lighting assembly 106 can be changed from those shown in the drawings to address particular applications of the device 100. Another possible modification is to use a slot rather than the holes in either or both of the elongated tubes.

The embodiments of the invention described hereinabove are intended to describe the best mode known of practicing the invention and to enable others skilled in the art to utilize the invention.

What is claimed is:

1. A special effect device for utilizing theatrical smoke to create a simulated fire effect comprising:

first means for generating a theatrical smoke curtain along a line that extends from a first location to a second location;

second means for modulating the position of a theatrical smoke curtain produced by said first means; and third means for lighting a modulated theatrical smoke curtain produced by said first and second means.

2. A special effect device, as claimed in claim 1, wherein:

said first means comprises a theatrical smoke emission manifold.

3. A special effect device, as claimed in claim 2, wherein:

said first means comprises a gas emission manifold.

4. A special effect device, as claimed in claim 3, wherein:

said first means comprises a housing that defines a slot and an outlet port for said slot; and said theatrical smoke emission manifold is located between said gas emission manifold and an outlet port of said slot.

5. A special effect device, as claimed in claim 1, wherein:

said first means comprises a theatrical smoke emission manifold having a first terminal end, a second terminal end, and an inlet port located between said first and second terminal ends.

6. A special effect device, as claimed in claim 1, wherein:

said first means comprises a theatrical smoke emission manifold that comprises an inlet port and a plurality of outlet ports with said plurality of outlet ports presenting a profile for resistance to the flow of theatrical smoke that decreases with increasing distance from said inlet port.

7. A special effect device, as claimed in claim 1, wherein:

said first means comprises a gas emission manifold having a first terminal end, a second terminal end, and an inlet port located between said first and second terminal ends.

8. A special effect device, as claimed in claim 1, wherein:

said first means comprises a gas emission manifold that comprises an inlet port and a plurality of outlet ports with said plurality of outlet ports presenting a profile for resistance to the flow of gas that decreases with increasing distance from said inlet port.

9. A special effect device for utilizing theatrical smoke to create a simulated fire effect comprising:

a housing that defines an interior volume and an outlet port that communicates with the ambient atmosphere;

means for establishing a gas flow within said interior volume that at least partially exhausts through said outlet port;

a theatrical smoke emission manifold that is substantially located within said interior volume and so as to be located within a gas flow created by said means for establishing a gas flow;

an air modulator for producing a flow of air for altering the position of a theatrical smoke curtain produced adjacent to said outlet port; and a lighting system for projecting light onto a modulated theatrical smoke curtain produced adjacent to said outlet port.

10. A special effect device, as claimed in claim 9, wherein:

said housing comprises a first portion that defines a chamber and a second portion that defines a slot; and said slot extends between said chamber and said outlet port.

11. A special effect device, as claimed in claim 10, wherein:

said first portion of said housing being a substantially closed surface.

12. A special effect device, as claimed in claim 10, wherein:

said chamber having a lateral cross-sectional chamber width;

said slot having a lateral cross-sectional slot width;

said lateral cross sectional chamber width is greater than said lateral cross-sectional slot width.

13. A special effect device, as claimed in claim 9, wherein:

said means for establishing a gas flow comprises a gas emission manifold.

14. A special effect device, as claimed in claim 13, wherein:

said theatrical smoke emission manifold is located between said gas emission manifold and said outlet port.

15. A special effect device, as claimed in claim 13, wherein:

said theatrical smoke emission manifold comprises first and second theatrical smoke emission manifold terminal ends and a theatrical smoke emission manifold inlet port that is located between said first and second theatrical smoke emission manifold terminal ends; and said gas emission manifold comprises first and second gas emission manifold terminal ends and a gas emission manifold inlet port that is located between said first and second gas emission manifold terminal ends.

16. A special effect device, as claimed in claim 13, wherein:

said theatrical smoke emission manifold comprises a theatrical smoke emission outlet structure that presents a desired profile for the resistance to the flow of theatrical smoke; and said gas emission manifold comprises a gas emission outlet structure that presents a desired profile for the resistance to the flow of gas.

17. A special effect device for utilizing theatrical smoke to create a simulated fire effect comprising:

a housing that defines an interior volume, said interior volume comprising a chamber and a slot that extends between a slot/chamber junction and an outlet port that communicates with the ambient atmosphere;

a theatrical smoke emission manifold that is substantially located within said interior volume;

a gas emission manifold that is substantially located within said interior volume;

an air modulator for producing a flow of air for altering the position of a theatrical smoke curtain produced adjacent to said outlet port; and a lighting system for projecting light onto a modulated theatrical smoke curtain produced adjacent to said outlet port.

18. A special effect device, as claimed in claim 17, wherein:

said theatrical smoke emission manifold is located between said gas emission manifold and said outlet port.

19. A special effect device, as claimed in claim 17, wherein:

said theatrical smoke emission manifold is located between said gas emission manifold and said slot/chamber junction.

20. A special effect device, as claimed in claim 17, wherein:

said theatrical smoke emission manifold is located adjacent to said slot chamber junction and at least a portion of said theatrical smoke emission manifold is spaced from said housing so as to define a passageway for gas provided by said gas emission manifold to enter said slot.

21. A special effect device, as claimed in claim 17, wherein:

said theatrical smoke emission manifold is located adjacent to said slot/chamber junction and at least a portion of said theatrical smoke emission manifold is spaced from said housing so as to define first and second passageways for gas provided by said gas emission manifold to enter said slot.

22. A special effect device, as claimed in claim 17, wherein:

said theatrical smoke emission manifold comprises an outlet structure for venting theatrical smoke and that substantially lies in a plane defined by said slot.

23. A special effect device, as claimed in claim 17, wherein:

said gas emission manifold comprises an outlet structure for venting gas that directs gas into said interior volume in a direction away from said slot.

24. A special effect device, as claimed in claim 17, wherein:

said theatrical smoke emission manifold comprises first and second theatrical smoke emission manifold terminal ends and a theatrical smoke emission manifold inlet port that is located between said first and second theatrical smoke emission manifold terminal ends; and said gas emission manifold comprises first and second gas emission manifold terminal ends and a gas emission manifold inlet port that is located between said first and second gas emission manifold terminal ends.

25. A special effect device, as claimed in claim 17, wherein:

said theatrical smoke emission manifold comprises a theatrical smoke emission outlet structure that presents a desired profile for the resistance to the flow of theatrical smoke; and said gas emission manifold comprises a gas emission outlet structure that presents a desired profile for the resistance to the flow of gas.

26. A special effect device for utilizing theatrical smoke to create a simulated fire effect comprising:

a housing that defines an interior volume, said interior volume comprising a chamber and a slot that extends between a slot/chamber junction and an outlet port that communicates with the ambient atmosphere;

a theatrical smoke emission manifold substantially located within said interior volume and comprising a theatrical smoke emission manifold elongated hollow body having a first smoke emission manifold terminal end and a second smoke emission manifold terminal end, a theatrical smoke emission manifold inlet port for providing theatrical smoke to a theatrical smoke emission interior space of said theatrical smoke emission manifold elongated body, and a theatrical smoke emission manifold outlet structure for venting smoke from said theatrical smoke emission interior space;

a gas emission manifold substantially located within said interior volume and comprising a gas emission manifold elongated hollow body having a first gas emission manifold terminal end and a second gas emission manifold terminal end, a gas emission manifold inlet port for providing gas to a gas emission manifold interior space of said gas emission manifold elongated hollow body, and a gas emission manifold outlet structure for venting gas from said gas emission manifold interior space;

an air modulator for producing a flow of air for altering the position of a theatrical smoke curtain produced adjacent to said outlet port; and a lighting system for projecting light onto a theatrical smoke curtain produced adjacent to said outlet port.

27. A special effect device, as claimed in claim 26, wherein:

said smoke emission manifold inlet port is located between said first and second smoke emission manifold terminal ends of said smoke emission manifold elongated hollow body; and said gas emission manifold inlet port is located between said first and second gas emission manifold terminal ends of said gas emission manifold elongated hollow body.

28. A special effect device, as claimed in claim 26, wherein:

said smoke emission manifold inlet port is substantially located at a midpoint between said first and second smoke emission manifold terminal ends of said smoke emission manifold elongated hollow body;

said gas emission manifold inlet port is substantially located at a midpoint between said first and second gas emission manifold terminal ends of said gas emission manifold elongated hollow body.

29. A special effect device, as claimed in claim 26, wherein:

said theatrical smoke emission manifold outlet structure is adapted to facilitate a desired theatrical smoke density profile;

said theatrical smoke emission manifold inlet port is located to substantially avoid interfering with the production of said desired theatrical smoke density profile by said theatrical smoke emission manifold outlet structure;

said gas emission manifold outlet structure is adapted to facilitate a desired theatrical smoke density profile; and said theatrical smoke emission manifold inlet port is located to substantially avoid interfering with the production of said desired theatrical smoke density profile by said theatrical smoke emission manifold outlet structure.

30. A special effect device, as claimed in claim 26, wherein:

said theatrical smoke emission manifold outlet structure presents a desired profile for resistance to the flow of theatrical smoke; and said gas emission manifold outlet structure presents a desired profile for resistance to the flow of gas.

31. A special effect device, as claimed in claim 26, wherein:

said theatrical smoke emission manifold outlet structure presents a profile for resistance to the flow of theatrical smoke that decreases with increasing distance from said theatrical smoke emission manifold inlet port; and said gas emission manifold outlet structure presents a profile for resistance to the flow of gas that decreases with increasing distance from said gas emission manifold inlet port.

32. A special effect device, as claimed in claim 26, wherein:

said theatrical smoke emission outlet structure comprises one of: a slot and a plurality of holes; and said gas emission outlet structure comprises one of: a slot and a plurality of holes.

33. A special effect device, as claimed in claim 26, wherein:

said theatrical smoke emission manifold is substantially located in said chamber; and said gas emission manifold is substantially located in said chamber.

34. A special effect device, as claimed in claim 33, wherein:

said theatrical smoke emission manifold is located between said slot and said gas emission manifold.

35. A special effect device for utilizing theatrical smoke to create a simulated fire effect comprising:

a housing that defines an interior volume, said interior volume comprising a chamber and a slot that extends between a slot/chamber junction and an outlet port that communicates with the ambient atmosphere;

a theatrical smoke emission manifold substantially located within said interior volume and comprising a theatrical smoke emission manifold elongated hollow body having a first theatrical smoke emission manifold terminal end and a second theatrical smoke emission manifold terminal end, a theatrical smoke emission manifold inlet port for providing theatrical smoke to a theatrical smoke emission manifold interior space of said theatrical smoke emission manifold elongated body, and a theatrical smoke emission manifold plurality of outlet ports for venting theatrical smoke from said theatrical smoke emission manifold interior space and that presents a desired profile for the resistance to the flow of theatrical smoke;

a gas emission manifold substantially located within said interior volume and comprising a gas emission manifold elongated hollow body having a first gas emission manifold terminal end and a second gas emission manifold terminal end, a gas emission manifold inlet port for providing gas to a gas emission manifold interior space of said gas emission manifold elongated body, and a gas emission manifold plurality of outlet ports for venting gas from said gas emission manifold interior space and that presents a desired profile for the resistance to the flow of gas;

an air modulator for producing a flow of air for altering the position of a theatrical smoke curtain produced adjacent to said outlet port; and a lighting system for projecting light onto a theatrical smoke curtain produced adjacent to said outlet port.

36. A special effect device, as claimed in claim 35, wherein:

at least one of said theatrical smoke emission manifold plurality of outlet ports and said gas emission manifold plurality of outlet ports comprises a first hole having a first diameter and a second hole having a second diameter that is greater than said first diameter.

37. A special effect device, as claimed in claim 35, wherein:

said theatrical smoke emission manifold plurality of outlet ports comprises a first outlet port and a second outlet port;

wherein said first outlet port is located a first distance from said theatrical smoke emission manifold inlet port;

wherein said second outlet port is located a second distance from said first outlet port; and wherein said second distance is less than said first distance.

38. A special effect device, as claimed in claim 35, wherein:

said gas emission manifold plurality of outlet ports comprises a first outlet port and a second outlet port;

wherein said first outlet port is located a first distance from said gas emission manifold inlet port;

wherein said second outlet port is located a second distance from said first outlet port; and wherein said second distance is less than said first distance.

39. A special effect device, as claimed in claim 35, wherein:

at least a portion of said theatrical smoke emission manifold plurality of outlet ports define a straight line.

40. A special effect device, as claimed in claim 35, wherein:

at least a portion of said theatrical smoke emission manifold plurality of outlet ports define a curved line.

41. A special effect device, as claimed in claim 35, wherein:

said theatrical smoke emission manifold plurality of outlet ports define a line that lies in a plane defined by said slot.

42. A special effect device, as claimed in claim 41, wherein:

at least a portion of said plane is one of the following: a flat plane and a curved plane.

43. A special effect device, as claimed in claim 35, wherein:

said smoke emission manifold inlet port is located between said first and second theatrical smoke emission manifold terminal ends of said theatrical smoke emission manifold elongated hollow body; and said gas emission manifold inlet port is located between said first and second gas emission manifold terminal ends of said gas emission manifold elongated hollow body.

44. A special effect device, as claimed in claim 35, wherein:

said theatrical smoke emission manifold inlet port coincides with said first theatrical smoke emission manifold terminal end;

said gas emission manifold inlet port coincides with said first gas emission manifold terminal end.

45. A special effect device, as claimed in 35, wherein:

said theatrical smoke emission manifold is substantially located within said chamber and between said slot/chamber junction slot and said gas emission manifold.

* * * * *

UNITED STATES PATENT AND TRADEMARK OFFICE

CERTIFICATE OF CORRECTION

PATENT NO. : 6,802,782 B2
APPLICATION NO. : 10/249949
DATED : October 12, 2004
INVENTOR(S) : Hall et al.

It is certified that error appears in the above-identified patent and that said Letters Patent is hereby corrected as shown below:

The Title page, showing an illustrative figure, should be deleted and substitute therefor the attached Title page.
Delete drawing sheet 1, consisting of FIG. 1, and replace with drawing sheet 1, consisting of FIG. 1 (attached);
Delete drawing sheet 3, consisting of FIG. 2B, and replace with drawing sheet 3, consisting of FIG. 2B (attached);
Delete drawing sheet 4, consisting of FIG. 3, and replace with drawing sheet 4, consisting of FIG. 3 (attached);
Delete drawing sheet 5, consisting of FIG. 4, and replace with drawing sheet 4, consisting of FIG. 4 (attached); and
Delete drawing sheet 10, consisting of FIG. 9, and replace with drawing sheet 10, consisting of FIG. 9 (attached).
Column 1, line 25, delete “located a”; and insert --located at a--;
Column 2, line 59, delete “spaced form”; and insert --spaced from--;
Column 5, line 39, delete “portion 22 has”; and insert --portion 26 has--;
Column 6, line 40, delete “port 28 is”; and insert --port 38 is--;
Column 6, line 42, delete “port 28 is”; and insert --port 38 is--;
Column 6, line 43, delete “port 28 between”; and insert --port 38 between--;
Column 6, line 56, delete “28 can”; and insert --38 can--;
Column 6, line 62, delete “port 28 is”; and insert --port 38 is--;
Column 6, line 64, delete “port 28 impacts” and insert --port 38 impacts--;
Column 6, line 67, delete “appreciate”; and insert --appreciated--;
Column 6, line 67, delete “port 28 between”; and insert --port 38 between--;
Column 7, line 3, delete “port 28”; and insert --port 38--;
Column 7, line 29, delete “comprises condensate”; and insert --comprises a condensate--;
Column 7, line 43, delete “device 52”; and insert --device 54--;
Column 7, line 45, delete “nozzle for”; and insert --nozzle 56 for--;
Column 7, line 49, delete “device 52”; and insert --device 54--;
Column 7, line 50, delete “fan 54”; and insert --fan 52--;
Column 7, line 52, delete “Other for”; and insert --Other devices for--;

Column 13, line 14, delete "126 is"; and insert --128 is--;
Column 13, line 14, delete "adjacent slot/chamber"; and insert --adjacent to the slot/chamber--;
Column 13, line 16, delete "tube 126"; and insert --tube 128--;
Column 13, line 43, delete "brackets 158"; and insert --brackets 158A, 158B--.

Signed and Sealed this

Twenty-third Day of March, 2010

David J. Kappos

David J. Kappos
*Director of the United States Patent and Trademark Office*

(12) United States Patent
Hall et al.

(10) Patent No.: US 6,802,782 B2
(45) Date of Patent: Oct. 12, 2004

(54) APPARATUS FOR PRODUCING A FIRE SPECIAL EFFECT

(75) Inventors: Rockne Hall, Newhall, CA (US); Joseph W. Starr, Saugus, CA (US)

(73) Assignee: Technifex, Inc., Valencia, CA (US)

( * ) Notice: Subject to any disclaimer, the term of this patent is extended or adjusted under 35 U.S.C. 154(b) by 0 days.

(21) Appl. No.: 10/249,949

(22) Filed: May 21, 2003

(65) Prior Publication Data

US 2004/0077416 A1 Apr. 22, 2004

Related U.S. Application Data

(63) Continuation-in-part of application No. 10/063,264, filed on Apr. 4, 2002, now Pat. No. 6,685,574.

(51) Int. Cl.[7] ..... A63J 5/02
(52) U.S. Cl. ..... 472/65; 40/427
(58) Field of Search ..... 472/65, 66, 61, 472/57, 137; 40/427, 428, 439, 440, 441

(56) References Cited

U.S. PATENT DOCUMENTS 643,493 A * 2/1900 Fuller ..... 472/65
3,334,816 A * 8/1967 Shuzo ..... 239/18
3,432,439 A * 3/1969 Dickman ..... 102/334
4,002,333 A * 1/1977 Gotoh ..... 472/65
4,026,544 A * 5/1977 Plambeck et al. ..... 472/64
4,426,021 A * 1/1984 Rosenthal ..... 222/129.1
4,994,092 A * 2/1991 Eklund et al. ..... 44/629
5,407,392 A * 4/1995 Laijoki-Puska ..... 472/65
5,989,128 A * 11/1999 Baker et al. ..... 472/65

* cited by examiner

*Primary Examiner*—Kien Nguyen
(74) *Attorney, Agent, or Firm*—Holland & Hart LLP; Christopher J. Kulish, Esq.

(57) ABSTRACT

The present invention provides a device for producing a fire special effect using a curtain of theatrical smoke. In one embodiment, the device comprises a theatrical smoke console for producing a curtain of theatrical smoke, an air modulator for providing a varying current of air that modulates the curtain of theatrical smoke produced by the console, and a lighting assembly that produces a flood of colored light that is projected onto the modulated curtain of theatrical smoke produced by the console and air modulator.

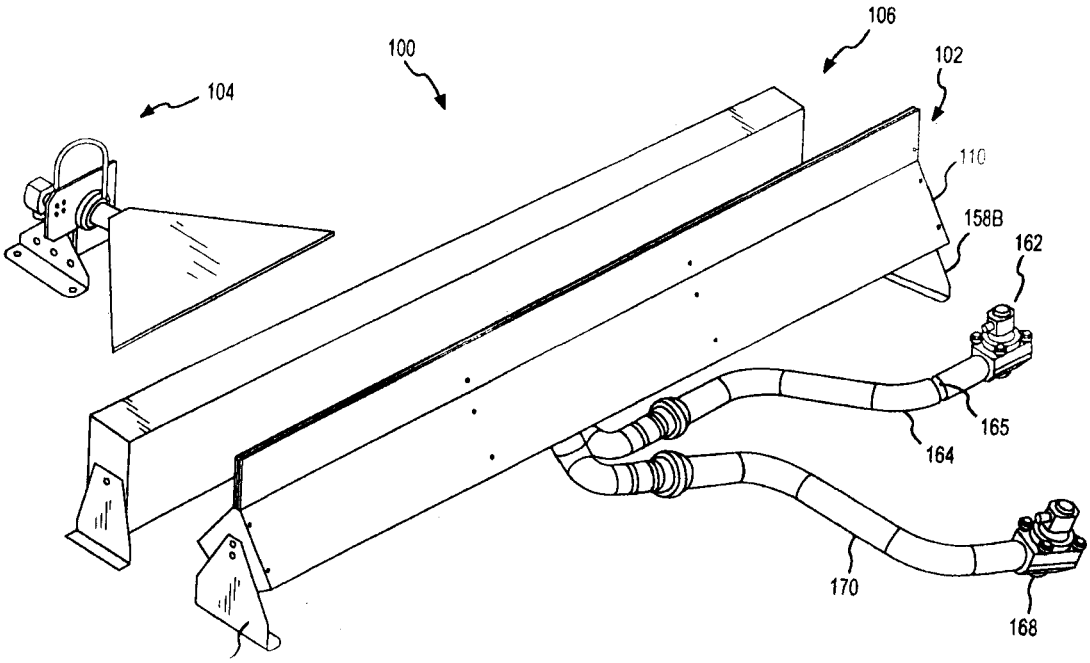

45 Claims, 12 Drawing Sheets